US008204416B2

(12) United States Patent
Calamita et al.

(10) Patent No.: US 8,204,416 B2
(45) Date of Patent: Jun. 19, 2012

(54) METHOD AND APPARATUS FOR MEASURING COLOR-TO-COLOR REGISTRATION

(75) Inventors: James P. Calamita, Spencerport, NY (US); Robert P. Loce, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 664 days.

(21) Appl. No.: 12/326,566

(22) Filed: Dec. 2, 2008

(65) Prior Publication Data

US 2010/0135702 A1 Jun. 3, 2010

(51) Int. Cl.
*G03G 15/01* (2006.01)

(52) U.S. Cl. ..... 399/301; 399/302

(58) Field of Classification Search ..... 399/301; 347/116

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 5,031,032 | A | 7/1991 | Perregaux et al. |
| 5,326,093 | A | 7/1994 | Sollitt |
| 5,473,513 | A | 12/1995 | Quinn |
| 5,489,969 | A | 2/1996 | Soler et al. |
| 5,545,913 | A | 8/1996 | Quinn et al. |
| 5,552,828 | A | 9/1996 | Perregaux |
| 5,568,246 | A | 10/1996 | Keller et al. |
| 5,570,172 | A | 10/1996 | Acquaviva |
| 5,596,416 | A | 1/1997 | Barry et al. |
| 5,604,362 | A | 2/1997 | Jedlicka et al. |
| 5,691,760 | A | 11/1997 | Hosier et al. |
| 5,748,344 | A | 5/1998 | Rees |
| 5,995,721 | A | 11/1999 | Rourke et al. |
| 6,493,083 | B2 | 12/2002 | Parisi et al. |
| 6,529,643 | B1 | 3/2003 | Loce et al. |
| 6,554,276 | B2 | 4/2003 | Jackson et al. |
| 6,607,320 | B2 | 8/2003 | Bobrow et al. |
| 6,621,576 | B2 | 9/2003 | Tandon et al. |
| 6,654,136 | B2 | 11/2003 | Shimada |
| 6,816,269 | B1 | 11/2004 | Loce et al. |
| 7,058,332 | B2 | 6/2006 | Moroi |
| 2003/0175602 | A1 | 9/2003 | Kazama |
| 2006/0092264 | A1 | 5/2006 | Matsuzaki et al. |
| 2006/0222378 | A1 | 10/2006 | Julien |

(Continued)

OTHER PUBLICATIONS

Wolberg, George "Digital Image Warping", IEEE Computer Society Press, Los Alamitos, California, 1990, pp. 1-10.

*Primary Examiner* — David Gray
*Assistant Examiner* — G. M. Hyder
(74) *Attorney, Agent, or Firm* — Fay Sharpe LLP

(57) ABSTRACT

In one embodiment, a method of measuring color-to-color registration includes: a) marking test pattern images on an image receiving member using a reference color separation station and a first color separation station over a process direction span in relation to selected target media and a cyclic characteristic of a multicolor marking platform, b) detecting each test pattern image, c) determining a registration measurement associated with the first color separation in relation to the reference color separation for each test pattern image, and d) determining a repeatable registration error pattern associated with the first color separation and the selected target media in relation to the cyclic characteristic based at least in part on the registration measurements determined in c). In one embodiment, the multicolor marking platform includes a marking engine, a controller, an image receiving member, a sensor, color registration measurement logic, and repeatable registration error determining logic.

25 Claims, 18 Drawing Sheets

U.S. PATENT DOCUMENTS

2006/0274337 A1 12/2006 Dalal et al.
2007/0053727 A1* 3/2007 Goto ..... 399/301
2007/0139715 A1 6/2007 Kazama et al.
2007/0145676 A1 6/2007 Biegelsen et al.
2007/0165283 A1 7/2007 Matsuzaki et al.
2007/0242980 A1* 10/2007 Kikuchi et al. ..... 399/167

* cited by examiner

METHOD AND APPARATUS FOR MEASURING COLOR-TO-COLOR REGISTRATION

BACKGROUND

The present exemplary embodiment relates generally to measuring color-to-color registration in a marking system with a marking engine that includes a plurality of different color separation stations. It finds particular application in conjunction with a multicolor xerographic printing system. However, it is to be appreciated that the present exemplary embodiment is also amenable to other types of marking systems, such as multicolor inkjet printing systems, multicolor copier systems, and multicolor multifunction marking systems.

Current color-to-color registration measurement and error correction algorithms, such as image-on-image (IOI) and real-time IOI control (RTIC), only consider a simple average shift in color-to-color misalignment (i.e., DC shift or zero (0) Hertz (Hz) shift). Given the current half-toning screen pattern on digital color printing presses, such as the iGen3 manufactured by Xerox Corporation of Norwalk, Conn., correction of color-to-color registration error using DC shifts may advertise approximately 85 micron color-to-color registration at the $95^{th}$ percentile. The average color-to-color misregistration achieved by these systems using DC shift measurements may be approximately 40 microns. However, current half-toning patterns are limited in their ability to provide photo quality output due to use of these registration measurement and correction techniques that correct for color-to-color DC shifts. There are no current color-to-color registration measurement techniques that can achieve photo quality output for the current half-toning patterns better than 40 micron color-to-color registration.

INCORPORATION BY REFERENCE

The following patents, applications, and publications, the disclosures of each being totally incorporated herein by reference, are mentioned: i) Wolberg, *Digital Image Warping*, IEEE Computer Society Press (1990); ii) U.S. Pat. No. 6,493,083, issued Dec. 10, 2002, entitled Method for Measuring Color Registration and Determining Registration Error in Marking Platform, to Parisi et al. and assigned to Xerox Corporation; iii) U.S. Pat. No. 6,529,643, issued Mar. 4, 2003, entitled System for Electronic Compensation of Beam Scan Trajectory Distortion, to Loce et al. and assigned to Xerox Corporation; iv) U.S. Pat. No. 6,816,269, issued Nov. 9, 2004, entitled Method and Apparatus for Electronic Registration in a Binary Image Path, to Loce et al. and assigned to Xerox Corporation; v) U.S. Patent Application Publication No. 2006/0092264, published May 4, 2006, entitled Image Forming Apparatus and Image Forming Method, to Matsuzaki et al. and assigned to Fuji Xerox Co., Ltd.; and vi) U.S. patent application Ser. No. 12/251,808, filed Oct. 15, 2008, entitled Digital Compensation Method And Apparatus, to Qiao et al. and assigned to Xerox Corporation.

BRIEF DESCRIPTION

In one aspect, a method of measuring color-to-color registration in a multicolor marking platform in provided. In one embodiment, the method includes: a) marking a plurality of test pattern images on an image receiving member using a reference color separation station and a first color separation station over a process direction span in relation to a selected target media and a cyclic characteristic of the multicolor marking platform, b) detecting each test pattern image on the image receiving member, c) determining a first registration measurement associated with the first color separation in relation to the reference color separation for each test pattern image, wherein the first registration measurements provide one of process measurements and cross-process measurements for the first color separation, and d) determining a first repeatable registration error pattern associated with the first color separation and the selected target media in relation to the cyclic characteristic based at least in part on the first registration measurements determined in c).

In another embodiment, the method of measuring color-to-color registration in a multicolor marking platform includes: a) marking a plurality of test pattern images on an image receiving member to form a test pattern image array using a reference color separation station and a first color separation station over a process direction span and a cross-process direction span in relation to a selected target media and a cyclic characteristic of the multicolor marking platform, b) detecting each test pattern image on the image receiving member, c) determining a process registration measurement associated with the first color separation in relation to the reference color separation for each test pattern image, d) determining a cross-process registration measurement associated with the first color separation in relation to the reference color separation for each test pattern image, e) determining a repeatable process registration error pattern associated with the first color separation and the selected target media in relation to the cyclic characteristic based at least in part on the process registration measurements determined in c), and f) determining a repeatable cross-process registration error pattern associated with the first color separation and the selected target media in relation to the cyclic characteristic based at least in part on the cross-process registration measurements determined in d).

In another aspect, a system for measuring color-to-color registration in a multicolor marking platform is provided. In one embodiment, the system includes a marking engine with a reference color separation station and a first color separation station, a controller in operative communication with the marking engine to selectively mark a plurality of test pattern images on an image receiving member over a process direction span using the reference color separation station and the first color separation station in relation to a selected target media and a cyclic characteristic of the multicolor marking platform, a sensor in operative communication with the controller to detect each test pattern image on the image receiving member, a color registration measurement logic in operative communication with the sensor and controller to determine a first registration measurement associated with the first color separation in relation to the reference color separation for each test pattern image, the first registration measurements providing one of process measurements and cross-process measurements for the first color separation, and a repeatable registration error determining logic in operative communication with the color registration measurement logic and the controller to determine a first repeatable registration error pattern associated with the first color separation and the selected target media in relation to the cyclic characteristic based at least in part on the first registration measurements determined by the color registration measurement logic.

DETAILED DESCRIPTION

Figure 1:
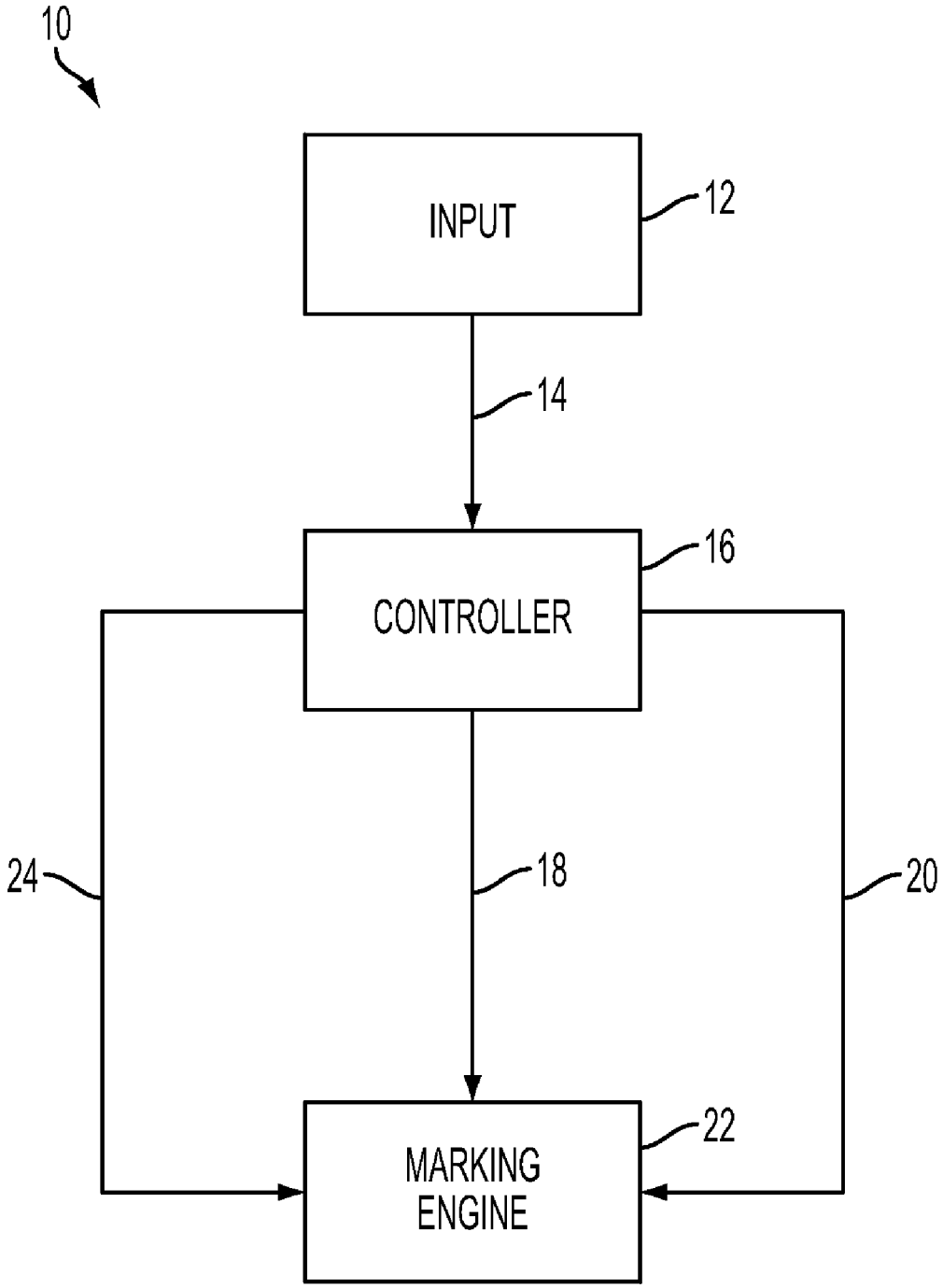
FIG. 1 is block diagram of an exemplary embodiment of a marking platform.

Aspects of the present disclosure relate to embodiments of a marking system that includes a marking engine that is capable of marking a multicolor image on target media using multiple color separation stations. The color separation stations may be operatively coupled for marking images from a common job stream, such as a set of images in digital form. For example, the color separation stations may be controlled by a common control system which, in one mode of operation, controls the color separations stations' marking of a job to ensure that marked target media is consistent. For example, consistent registration in the images marked on the target media by the color separation stations. The control system may adjust digital image data or one or more subsystem of the marking system such that markings by one or more color separation station are registered to match markings by a reference color separation station (e.g., a black color separation station) or another suitable standard. The color-to-color registration of the color separation stations may be determined by a sensor, either automatically, such with as an in situ (i.e., in-line) sensor with an automated feedback loop, or manually, such as with an off-line sensor.

The term "marking engine" is used herein to refer to a subsystem of a marking system that marks an image on target media. "Target media" can be paper, plastic, or any type of physical substrate suitable for receiving an image from the marking engine. The marking system may include a variety of other components, such as finishers, feeders, and the like, and may be embodied as a copier, printer, or multi-function device. A "print job" or "document" is normally a set of related sheets, usually one or more collated copy sets copied from a set of original print job sheets (or a set of electronic page images from a software application or an electronic document) from a particular user, or otherwise related. An "output destination" can be any post printing destination where the printed pages of a document are together, ordered in a sequence in which they can be assembled into in the finished document, such as a finisher or a temporary holding location. A "finisher" can be any post-printing accessory device such as an inverter, reverter, sorter, mailbox, inserter, interposer, folder, stapler, collater, stitcher, binder, overprinter, envelope stuffer, postage machine, output tray, or the like. A finisher may include several finishing stations. A finishing station usually processes one document at a time.

The "target media" is selectable and may be precut (e.g., letter, legal, A4 sheets) or web fed. Target media selections may include size, type, and color. Selections for media size may include letter, legal, tabloid, postcard, A4, and various other standard and custom media sizes with which the corresponding marking system is compatible. Selections for media type may include plain, transparency, heavyweight, recycled, bond, label, envelope, glossy, and various other standard and custom media types with which the corresponding marking system is compatible. Selections for media color include white, ivory, clear, and various other standard and custom media colors with which the corresponding marking system is compatible.

Turning now to the drawings, FIG. 1 an exemplary embodiment of a marking platform 10 may include an input 12, a controller 16, and a marking engine 22. The input 12 may provide digital image data 14 to the controller 16. The input 12 may include a scanner, individual computer, distributed computer network, electronic storage device, or any device capable of generating or storing the digital image. The controller 16 may process the digital image data 14 to create machine-readable image data 18 that may be provided to the marking engine 22. The controller 16 may also provide control signals 20 that control operations (e.g., image receiving member transport speed, positioning of marking members, dispense of marking material, etc.) within the marking engine 22. The marking engine 22 may receive the machine-readable image data 18 from the controller 16 and produce a human-readable version of the digital image. The marking engine 22 may include sensors that detect certain parameters (e.g., reflectance of test pattern images, coloration of test pattern images, alignment of markings within test pattern images, etc.) in the marking process and circuitry that scales and conditions the detected parameter measurements to create electrical signals. The electrical signals may be provided to the controller 16 as feedback signals 24 to facilitate control of color registration within the marking platform 10. The marking engine 22 may use toner marking, ink marking, or any marking technology capable of producing a human-readable image using marking material.

In marking technologies, the human-readable version of the digital image may be created by depositing marking material on a target media. The target media may be white paper. However, any type of target media suitable for marking by the marking engine 22 may be used. Marking platforms 10 that use ink as a marking technology include all the various forms of inkjet printing (e.g., ink, dye sublimation, wax, etc.) and all forms of printing presses that transfer images from inked plates to target media. Ink-jet printers and offset printing presses are common examples of marking platforms that implement ink marking technology. Marking platforms that use toner marking technology include electrophotographic printers, copiers, and multifunction systems. Toner marking is also known as electrophotographic marking.

Figure 2:
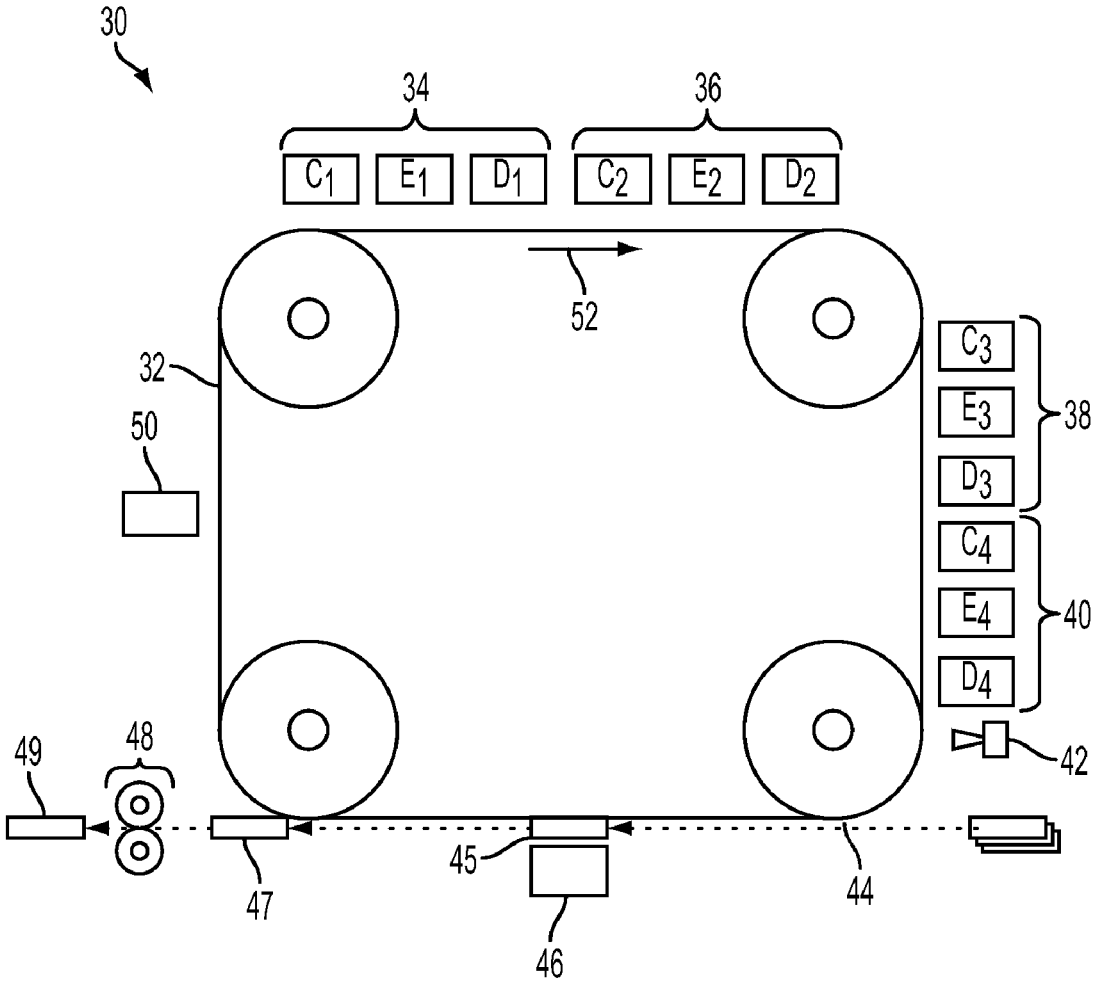
FIG. 2 is a block diagram of an exemplary embodiment of an electrophotographic marking engine.

Referring to FIG. 2, an exemplary embodiment a single pass multicolor electrophotographic marking engine ("single pass marking engine") 30 is shown. Since the art of electrophotographic marking is well known, FIG. 2 and the discussion that follows provides a brief overview of the various processing stations of the marking platform to which the color-to-color registration processes described herein relate. The single pass marking engine 30 may include a photoreceptor (PR) belt 32, four sets of color separation stations (34, 36, 38, 40), an optical sensor 42, a target media path 44, a transfer station 46, a fusing station 48, and a cleaning station 50. Each color separation station (34, 36, 38, 40) may include a charging station ($C_1$ . . . $C_4$), an imaging and exposing station ($E_1$ . . . $E_4$), and a developing station ($D_1$ . . . $D_4$). Accordingly, the single pass marking engine 30 may develop a composite full color image from four color separations (e.g., cyan (C), magenta (M), yellow (Y), and black (K)).

While FIG. 2 shows a single pass marking engine 30, the color-to-color registration processes described herein are not limited to this type of marking engine. On the contrary, the color-to-color registration processes described herein may also be implemented in all alternatives, modifications, and equivalents as may be included within the spirit and scope of this description and the appended claims. The color-to-color registration processes described herein are indeed applicable to any electrophotographic marking engine, including marking engines that use multiple pass architectures that either accumulate the composite multicolor image on the PR belt or the target media and marking engines that employ alternate single pass architectures (e.g., tandem architecture), including those that use an intermediate transfer belt (ITB). The color-to-color registration processes described herein are also applicable to ink marking engines, including ink-jet marking engines, printing presses, and printing technologies such as lithography. With regard to marking platforms incorporating an applicable marking engine architecture, the color-to-color registration processes described herein are applicable to copiers, printers, multifunction peripherals, and other devices using full color marking engines, high fidelity color marking engines, and highlight color marking engines that implement either process color separation, spot color separation, or a combination of process color separation and spot color separation.

With continuing reference to FIG. 2, the electrophotographic process begins at a charging station $C_1$ of a first color separation station 34. The following discussion basically tracks an array of test pattern images through one cycle of the electrophotographic process. The imaging region is advanced by the PR belt 32 in a clockwise direction as indicated by the process direction arrow 52 through the various stations comprising the complete process. The imaging region passes through the charging station $C_1$ where a corona generating device charges the region to a relatively high, substantially uniform, preferably negative potential. Next, the charged imaging region is advanced through an imaging and exposing station $E_1$. At the imaging and exposing station $E_1$, the uniformly charged imaging region is exposed by focusing a light source, such as a laser or light emitting diode (LED) array, on the region and discharging specific areas of the surface to create an electrostatic latent image representing the desired output from the first color separation station 34. Next, the imaging region is advanced through a developing station $D_1$. At the developing station $D_1$, a development system advances developer material consisting of carrier granules and charged toner particles into contact with the electrostatic latent image. The toner particles form a first developed toner image layer on the electrostatic latent image in the first color separation. The first color separation, for example, may be black (K).

The electrophotographic process continues as the imaging region advances to a second color separation station 36. At the second color separation station 36, the imaging region passes through a charging station $C_2$ where a corona recharge device is employed to raise the voltage level of both the toned and untoned areas of the imaging region to a substantially uniform level. The recharging device serves to recharge the PR to a predetermined level. Next, the recharged imaging region is advanced through an imaging and exposing station $E_2$. At the imaging and exposing station $E_2$, the uniformly charged imaging region is selectively discharged to create a latent image representing the desired output from the second color separation station 36. Next, the imaging region is advanced through a developing station $D_2$. At the developing station $D_2$, a development system presents toner particles to the electrostatic latent image. The toner particles form a second developed toner image layer on the imaging region in the second color separation. The second color separation, for example, may be yellow (Y).

The electrophotographic process continues as the imaging region advances through a third color separation station 38 and a fourth color separation station 40. For the third color separation station 38, the imaging region passes through a charging station $C_3$, an imaging and exposing station $E_3$, and a developing station $D_3$ in the same manner as for the second color separation station 36. The toner particles from the developing station $D_3$ form a third developed toner image layer on the imaging region in the third color separation. The third color separation, for example, may be magenta (M).

For the fourth color separation station 40, the imaging region passes through a charging station $C_4$, an imaging and exposing station $E_4$, and a developing station $D_4$, also in the same manner as for the second color separation station 36. The toner particles from the developing station $D_4$ form a fourth developed toner image layer on the imaging region in the fourth color separation. The fourth color separation, for example, may be cyan (C).

At this point, for the embodiment being described, a full color composite toner image is developed on the imaging region of the PR belt 32. Next, as shown, the PR belt 32 may advance past an optical sensor 42. In the embodiment being described, the optical sensor 42 may be positioned over the PR belt 32 above the area designated for test pattern image array and oriented toward the PR belt 32. As the PR belt 32 passes the optical sensor 42 the test pattern image array passes under the optical sensor 42.

In an alternate embodiment, the test pattern image array may be marked on target media and the optical sensor 42 may be positioned over the target media. This alternate embodiment permits the marking system to measure and correct for target media-induced registration error.

When the test pattern image array is to be marked on target media, the full color composite toner image for the test pattern image array on the PR belt 32 advances to the transfer station 46. As the toner image advances to the transfer station 46, a target media sheet 45 is simultaneously fed along a target media path 44 to the transfer station 46. At the transfer station 46, the back of the target media 45 is charged such that, when the target media 45 is moved into contact with the PR belt 32, the toner particles forming the test pattern image array are attracted and transferred to the target media 45 forming a transferred target media 47. The transferred target media 47 continues along the target media path 44 to a fusing station 48. At the fusing station 48, the transferred target media 47 passes between a heated fuser roller and a pressure roller and the toner particles are permanently affixed to the transferred target media 47, forming the fused target media 49. After the fusing station 48, a chute (not shown) guides the fused target media 49 to a catch tray (not shown) where it is accessible to an equipment operator. After the transfer operation, the PR belt 32 advances from the transfer station 46 to a cleaning station 50. At the cleaning station 50, residual toner particles are removed from the PR belt 32 to prepare it for another electrophotographic cycle.

In an alternate embodiment, the optical sensor 42 may be located between the transfer station 46 and the fusing station 48 and oriented to detect the color registration test pattern 58 on the transferred target media 47 as it proceeds along the target media path 44. Obviously, this alternate embodiment also requires the test pattern image array to be transferred to the target media 45. In another alternate embodiment, the optical sensor 42 may be located between the fusing station 48 and the catch tray (not shown) and oriented to detect the color registration test pattern 58 on the fused target media 49 as it proceeds along the target media path 44. In this alternate embodiment, the optical sensor 42 may be located outside the single pass marking engine 30, possibly in a finisher assembly (not shown) of the marking platform 10. In still another alternate embodiment, the optical sensor 42 may be located outside the marking platform 10 as a peripheral device. In this alternate embodiment, the optical sensor 42 may be connected to the marking platform 10 via an interface cable and an operator may place the fused target media 49 under the optical sensor 42 so that the test pattern image array can be detected.

Figure 3:
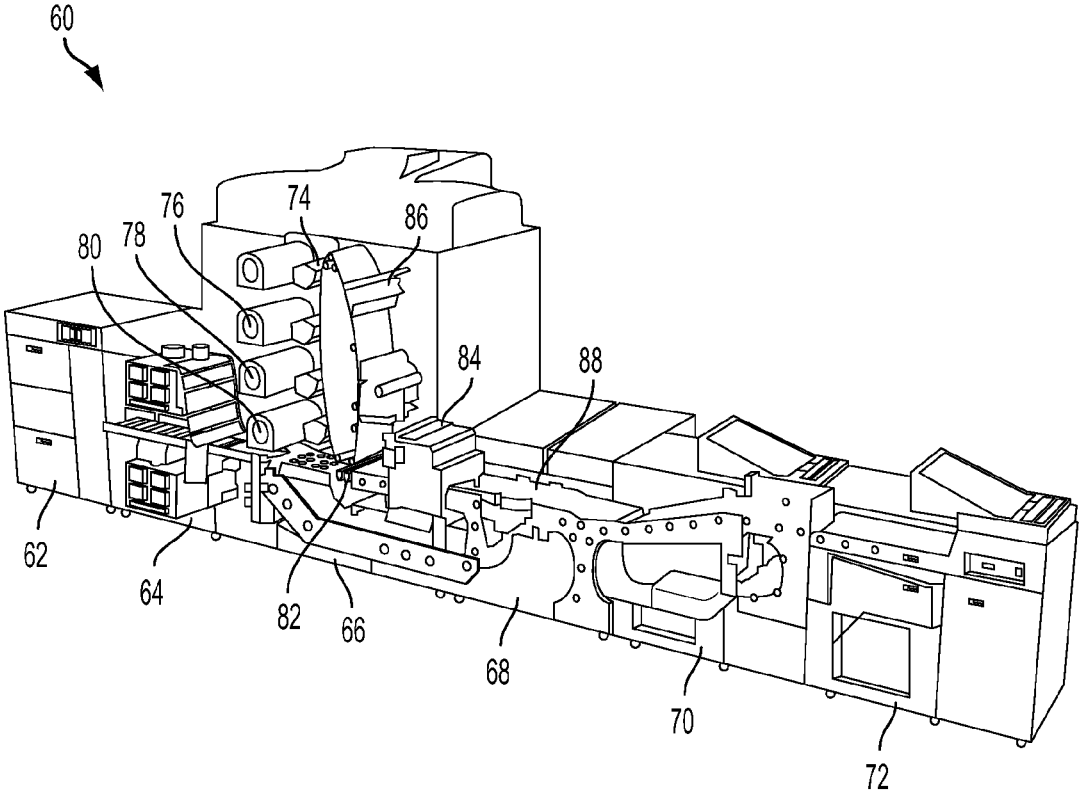
FIG. 3 is a perspective drawing of an exemplary embodiment of an electrophotographic marking system.

With reference to FIG. 3, an exemplary embodiment of a multicolor electrophotographic marking system 60 may include a feeder module 62, a feeder transport mechanism 64, a marking engine 66, a finishing transport mechanism 68, a first finishing module 70, and a second finishing module 72. The marking engine 66 may include four color separation stations 74, 76, 78, 80 for C, M, Y, and K color separations, a transfer station 82, a fusing station 84, and a cleaning station 86. Each color separation station may include a charging station, an imaging and exposing station, and a developing station. The finishing transport mechanism 68 may include a full-width sensor array 88, such as a spectrophotometer. The marking system 60 may be in operative communication with an input (not shown) and a controller (not shown). The input may include a remote work station adapted to transmit a job to the marking system. The controller may include a work station adapted to control various aspects of automated, semi-automated, and manual operations for the marking system in relation to a local operator and the input. This exemplary marking system 60 may be operated in the same manner as described above for the marking platform 10 of FIG. 1 and the marking engine 30 of FIG. 2.

In general, a method and apparatus associated with higher-order color-to-color registration for the various types of marking systems mentioned above is provided herein. This includes a method of measuring color registration to determine cyclical or repeatable registration error patterns that relate to subsequent marking jobs. For example, cyclical or repeatable registration error patterns may occur from page to page, as well as for a group of consecutive pages, such as consecutive pages associated with a belt revolution. The color registration measurements may be used in conjunction with any suitable error correction method that can respond to higher-order measurements during image processing or marking of target media during subsequent marking jobs.

The color-to-color registration measurement method may include marking an array of test pattern images to a subsystem transfer surface or a selected target media and sensing the marked test pattern image array. For example, the array could be sensed on a PR belt or ITB using an in situ sensor (e.g., a full-width array sensor, such as Cross-Process Uniformity Controller (CPUC) manufactured by Xerox Corporation of Norwalk, Conn.). The test pattern image array may permit measurement of higher-order color registration in at least one of process and cross-process (i.e., lateral) directions. For example, a test pattern image array may include one column and multiple rows to provide multiple color registration measurements at the same process dimension and multiple cross-process dimensions in relation to a given sheet of selected target media. Alternatively, a test pattern image array may include multiple columns and one row to provide multiple color registration measurements at multiple process dimensions and the same cross-process dimension in relation to a given sheet of selected target media. In yet another alternative, a test pattern image array may include multiple columns and multiple rows to provide multiple color registration measurements at multiple process dimensions and multiple cross-process dimensions in relation to a given sheet of selected target media. The number of columns and rows in the test pattern array could be based on sizes of image areas for selected target media (e.g., letter, legal, A4 media). Test pattern image arrays could be measured over multiple pages to determine trend or cyclic behavior, such as variations in color-to-color misregistration over a belt revolution.

The error correction method may incorporate any suitable technology that can respond to variations in color-to-color registration within a page, such as electronic registration algorithms used in the DocuColor 8000 Digital Press manufactured by Fuji Xerox Co., Ltd. of Tokyo, Japan. For additional information on electronic registration algorithms, see, e.g., U.S. Pat. Nos. 6,529,643 and 6,816,269. The error correction method may also incorporate mechanical adjustments to the components of the marking engine and target media feed subsystems.

Experiments on a DocuColor 8000 have shown that color-to-color registration errors may have a repeatable component for a given location within each target media page or within each belt revolution. Repeatable color-to-color registration errors, for example, may be due to target media-induced motion when each target media sheet comes in contact with the marking engine (e.g., PR, ITB, etc.). Repeatable color-to-color registration errors may also be due to belt or belt path inconsistencies, such as belt thickness or seams. The repeatable registration error information enables the error correction method to properly phase the correction (i.e., process or cross-process position and timing) since the timing of paper relative to the image is known.

Both measurement and correction of color-to-color registration error may be performed in real-time. Real-time processing for color-to-color registration measurement and real-time processing for error correction may be independent. For example, color-to-color registration measurement may be performed in real-time at periodic cycles, such as system power-up, system reset, or print job start cycles. Error correction may be performed in real-time during a print job based on the last color-to-color registration measurements.

In certain embodiments, color registration processes disclosed herein may limit registration errors to approximately 10 to 15 microns. This improved level of color registration may enable advancements in image quality. These advancements, for example, may permit use of dot-off-dot halftones, such as those used in certain photo-quality inkjet printers, in various other types of marking systems. Dot-off-dot halftoning, for example, can provide smoother textures than rotated halftones and may permit use of a larger color gamut. Dot-off-dot halftoning may also reduce the need for trapping and undesired effects such as color fringing.

In one embodiment, an array of multicolor test pattern images may be imaged on an image receiving member and scanned to measure the registration of one or more one colors (e.g., cyan (C), magenta (M), yellow (Y), etc.) to a reference color (e.g., black (K)) at multiple points (i.e., dimensions) in at least one of process and cross-process directions. This can be repeated based at least in part on a size for a selected target media or a length of a PR belt or ITB. For example, the array can be repeated based on the quantity of sheets of target media printed in one or more belt revolutions. The image receiving member, for example, may include target media, PR belt, ITB, or another marking engine component having an image transfer surface suitable for receiving the test pattern image arrays. The scanning can be performed in situ using, for example, a full page width in-line scan bar, such as the CPUC manufactured by Xerox Corporation of Norwalk, Conn. The scanning can also be performed off-line if the test pattern image arrays are marked on target media.

Figure 4:
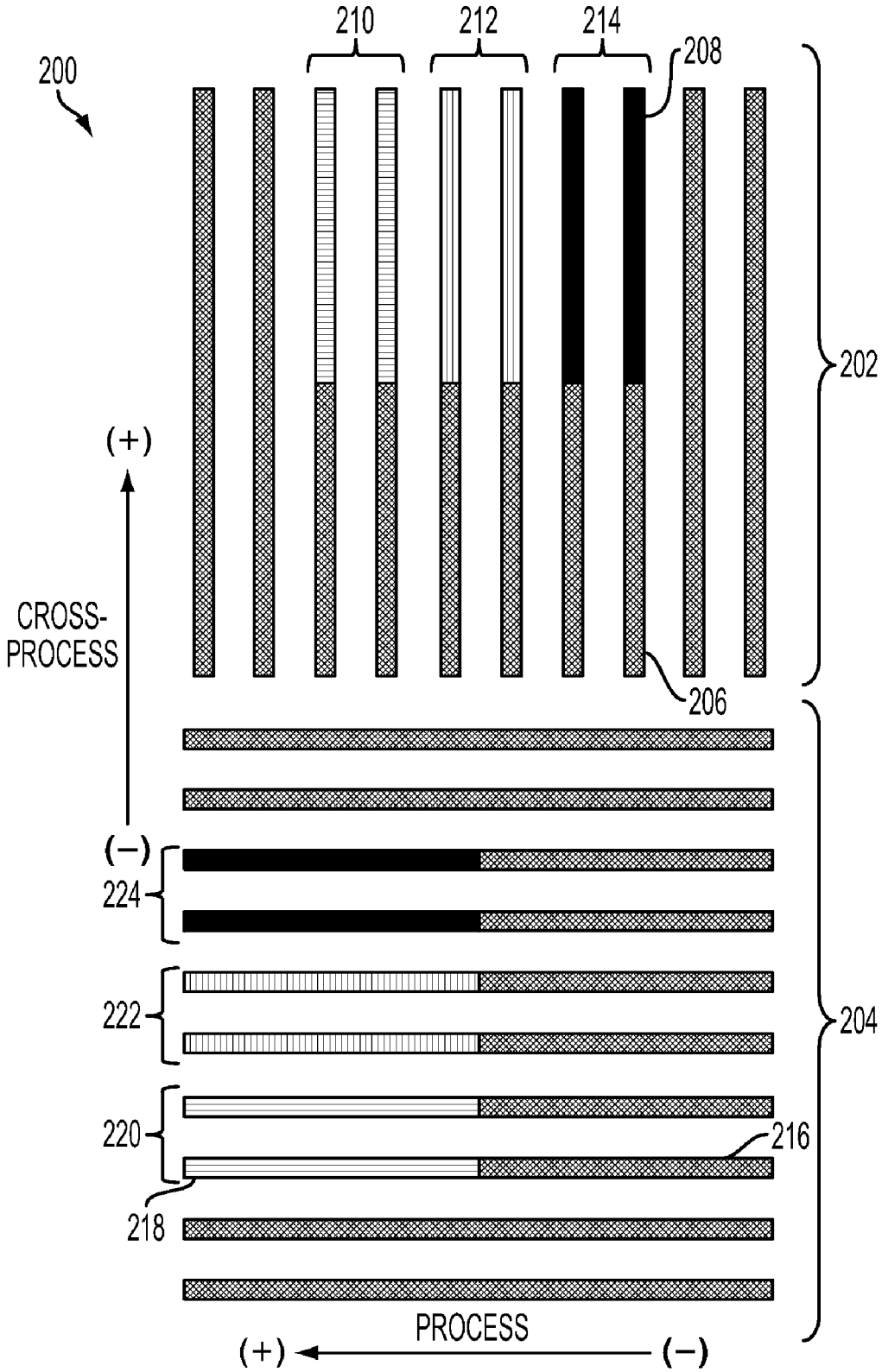
FIG. 4 shows an exemplary embodiment of a multicolor test pattern image.

With reference to FIG. 4, an exemplary multicolor test pattern image 200 may include an upper portion 202 and a lower portion 204. The upper portion 202 may include a plurality of multicolor vertical bars indicative of registration of one or more colors (e.g., C, M, Y, etc.) relative to a reference color (e.g., K) in the process direction. Each multicolor vertical bar may include a reference color portion 206 and a registered color portion 208. FIG. 4 shows a C pair 210 of multicolor vertical bars, an M pair 212 of multicolor vertical bars, and a Y pair 214 of multicolor vertical bars.

The lower portion 204 may include a plurality of multicolor horizontal bars indicative of registration of the one or more colors (e.g., C, M, Y, etc.) relative to the reference color (e.g., K) in the cross-process direction. Each multicolor horizontal bar may include a reference color portion 216 and a registered color portion 218. FIG. 4 shows a C pair 220 of multicolor horizontal bars, an M pair 222 of multicolor horizontal bars, and a Y pair 224 of multicolor horizontal bars.

This exemplary test pattern image 200 is suitable for use in a CMYK marking system. Other types of marking systems with more or less colors may implement a similar test pattern with similar markings for each color to be registered to a reference color. For example, a highlight color marking system may implement a similar test pattern indicative of registration of the highlight color to a reference color. Any suitable test pattern arrangement may be implemented for a corresponding multicolor marking system.

Figure 5:
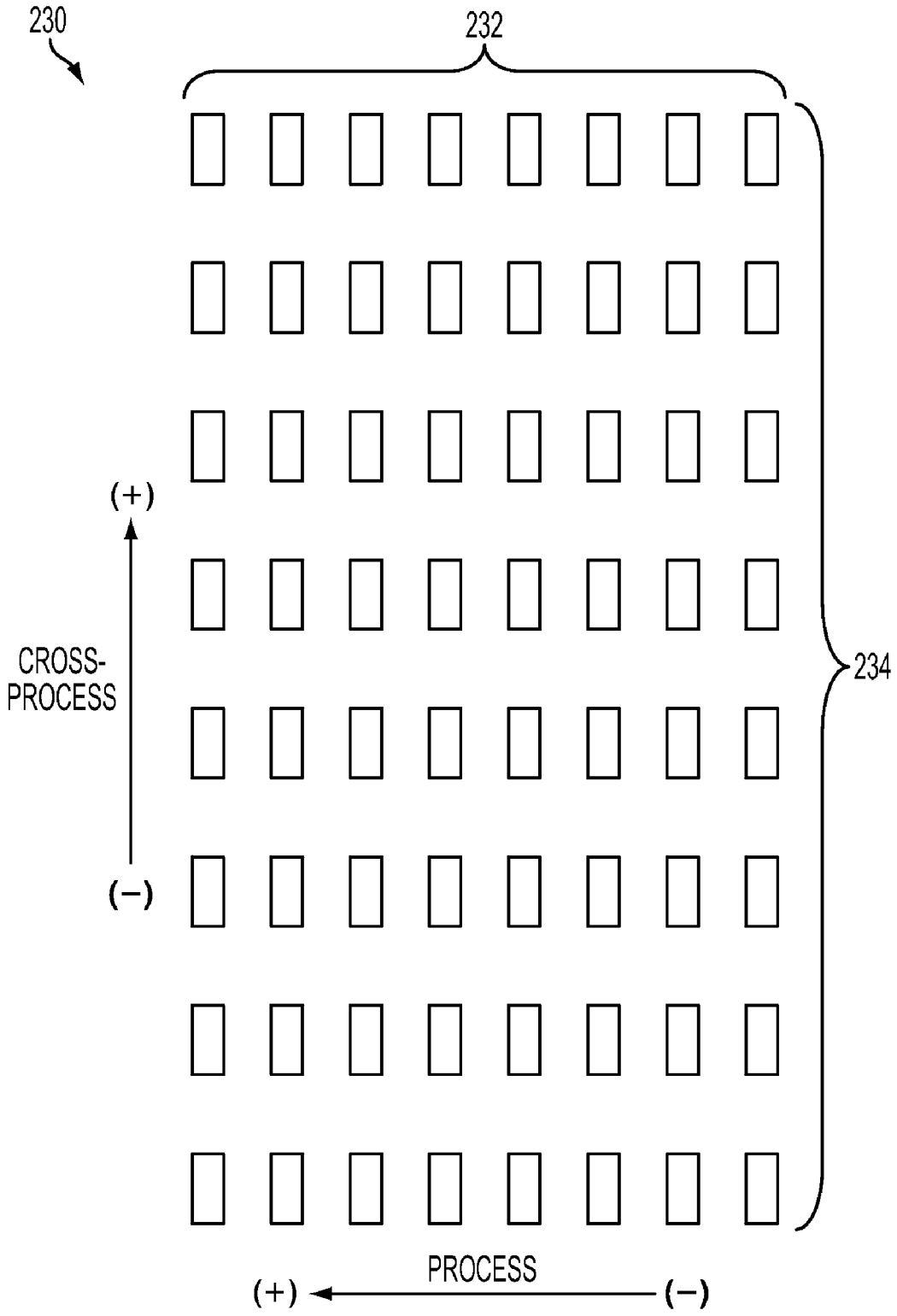
FIG. 5 shows an exemplary embodiment of an array of test pattern images.

With reference to FIG. 5, an exemplary array 230 of test pattern images (see FIG. 4) may be arranged in eight columns 232 and eight rows 234. Other arrays are also contemplated, including arrays with more or less columns and more or less rows.

Figure 6:
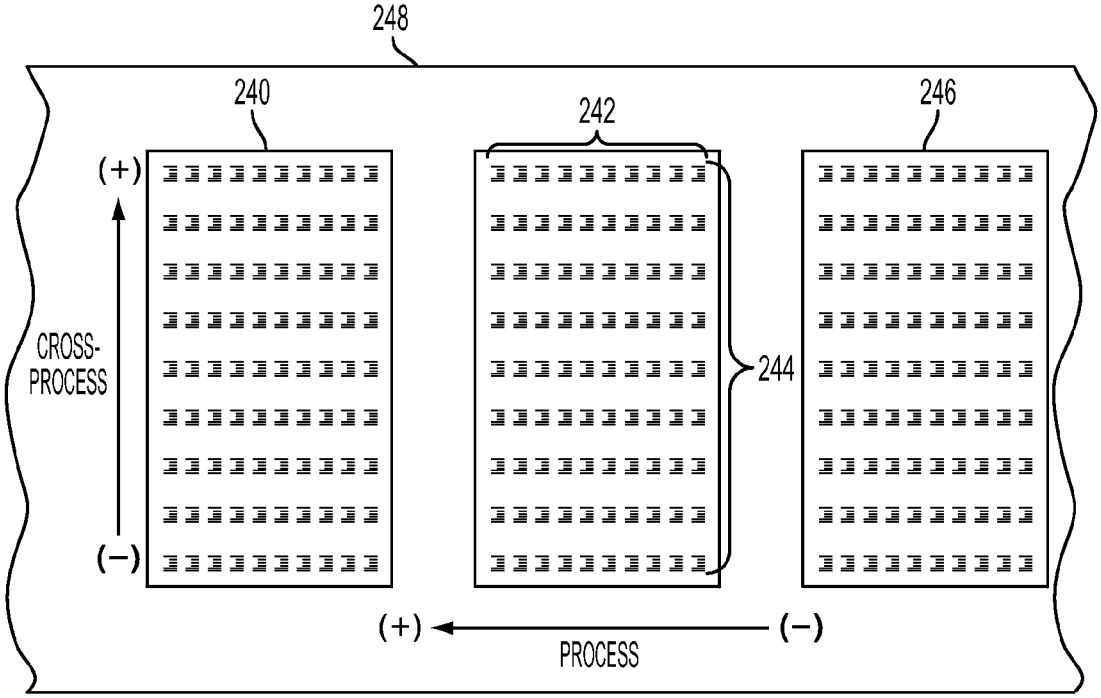
FIG. 6 shows an exemplary embodiment of an array of test pattern images marked on three consecutive sheets of a selected target media.

With reference to FIG. 6, an exemplary array 240 of test pattern images (see FIG. 4) may be arranged in ten columns 242 and nine rows 244. The test pattern image array 240 may be imaged on an image receiving member 246, such as a selected target media (e.g., letter, legal, A4 media). Multiple arrays 240 can be marked on an exemplary sequence of image receiving members 246 (e.g., three consecutive sheets of target media). The arrays 240 may be scanned in situ as the image receiving members 246 (e.g., sheets of marked target media) are transported along a target media path 248 to a finisher subsystem (not shown).

Figure 7:
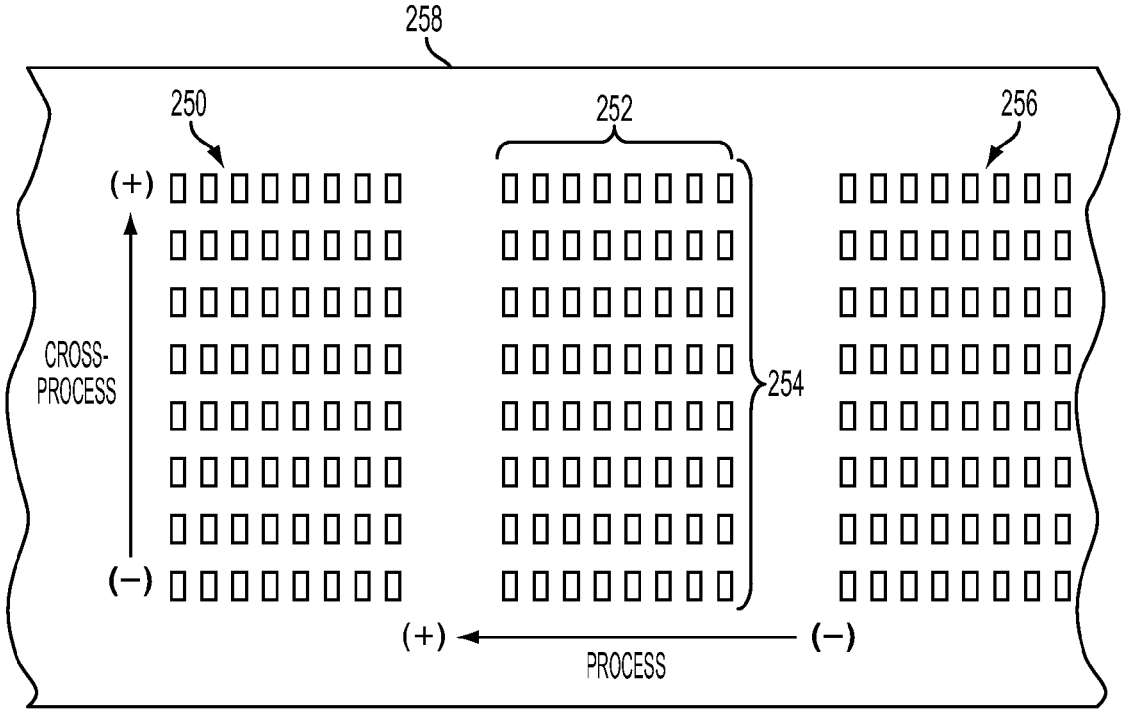
FIG. 7 shows an exemplary embodiment of an array of test pattern images marked on a component of a marking engine.

With reference to FIG. 7, an exemplary array 250 of test pattern images (see FIG. 4) may be arranged in eight columns 252 and eight rows 254. The test pattern image array 250 may be imaged on an image receiving member 258 (e.g., PR belt or ITB) of a marking engine subsystem (not shown). The size and area of the array 250 may correspond to a size for a selected target media (e.g., letter, legal, A4 media). Multiple arrays 250 can be imaged in consecutive sequence on the image receiving member 258 (e.g., PR belt or ITB). The arrays 250 may be scanned in situ on the image receiving member 258 as the imaged arrays 250 pass by a sensor (not shown) within the marking engine subsystem (not shown).

Figure 8:
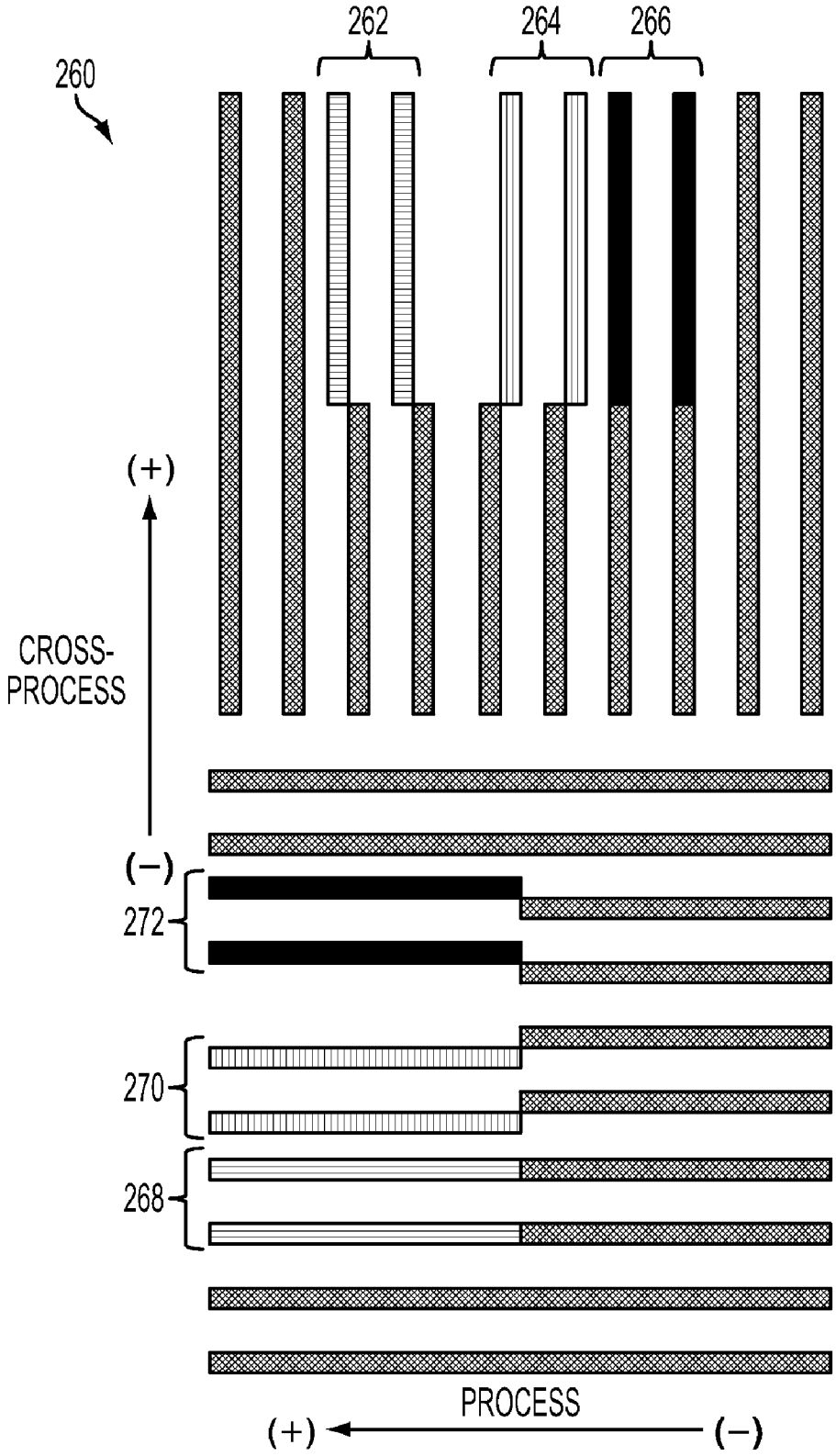
FIG. 8 shows an exemplary embodiment of a multicolor test pattern reflecting examples of color misregistration.

With reference to FIG. 8, an exemplary multicolor test pattern 260 (see FIG. 4) reflects positive (+) C registration error 262, negative (−) M registration error 264, and negligible Y registration error 266 in the process direction and negligible C registration error 268, negative (−) M registration error 270, and positive (+) Y registration error 272 in the cross-process direction.

In one exemplary embodiment of a color-to-color registration measurement process for an exemplary multicolor marking system, a desired target media is selected and a plurality of test pattern image arrays are marked on a plurality of sheets of the selected target media. The quantity of sheets marked with test pattern image arrays may be based at least in part on the size of the selected target media. For example, if the exemplary multicolor marking system can print seven sheets of the selected target media in one revolution of its PR belt or ITB, at least seven sheets of the selected target media may be marked with test pattern image arrays. In other embodiments, the quantity of sheets marked with test pattern image arrays may be based at least in part on the quantity of sheets for multiple revolutions of the PR belt or ITB. After a plurality of test pattern image arrays are marked and scanned, the registration for each color (e.g., C, M, Y, etc.) relative to a reference color (e.g., K) can be determined.

Figure 9A:
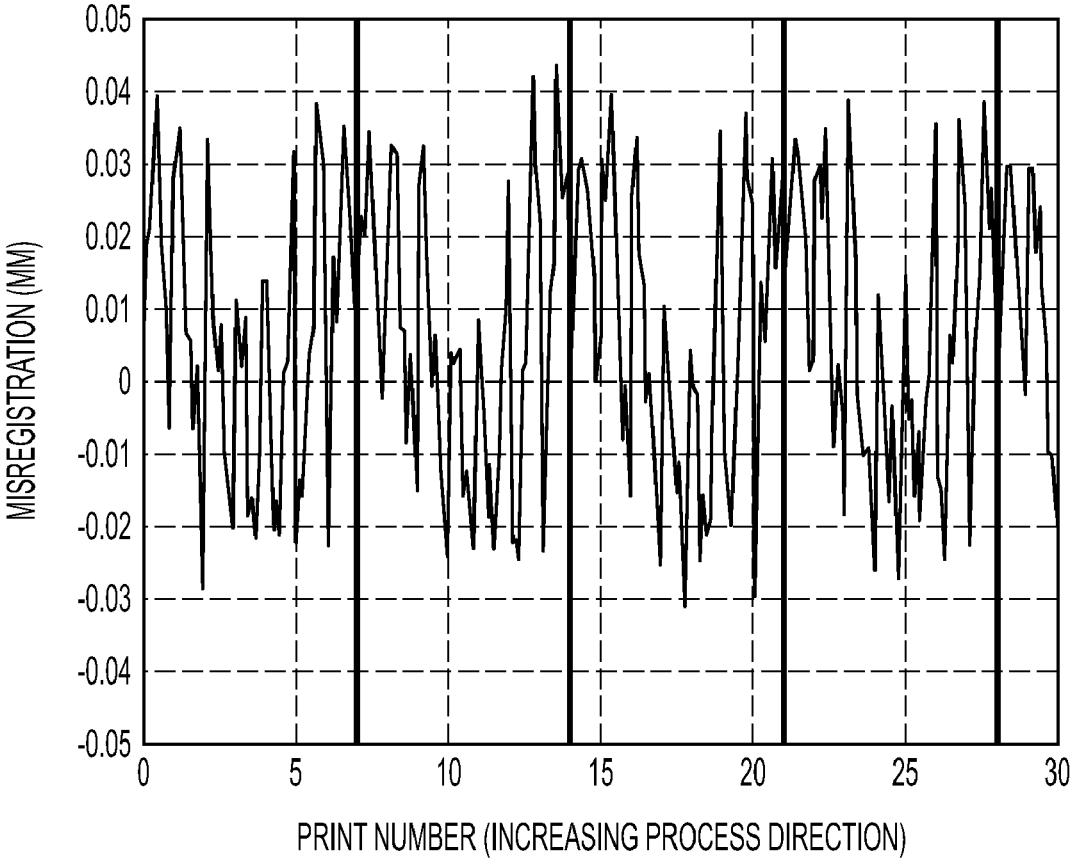
FIGS. 9A and 9B are charts showing examples of color registration measurements in relation to process direction.

With reference to FIG. 9A, an exemplary set of process-direction C-K registration measurements for a selected target media in an exemplary multicolor marking system may be plotted as a curve in a graph. The vertical axis of the graph may reflect positive and negative registration error in microns (i.e., millimeters (mm)) in relation to a zero reference value. The horizontal axis may reflect that test pattern images were scanned in relation to 30 sheets of selected target media. In this exemplary embodiment, a test pattern image array comprising one row and ten columns was marked for each sheet of selected target media and seven sheets of the selected target media were marked in each revolution of a PR belt. The process direction C-K registration measurements being based at least in part on the cross-process position of the row of test pattern images and the process position of each column. Notably, the resulting measurements reflect a C-K registration error pattern that is repeated for each group of seven sheets (i.e., where seven sheets were printed in each PR belt revolution). Similarly, process direction M-K and Y-K registration measurements may be obtained and plotted in the same manner as the process direction C-K registration error plot.

In the embodiment being described, a plurality of cross-process C-K registration measurements may be obtained and plotted in similar fashion to that described above for the process direction C-K registration error plot. The cross-process C-K registration measurements being based at least in part on the cross-process position of the row of test pattern images and the process position of each column. Similarly, cross-process M-K and Y-K registration measurements may be obtained and plotted in the same manner as the cross-process C-K registration error plot.

Figure 9B:
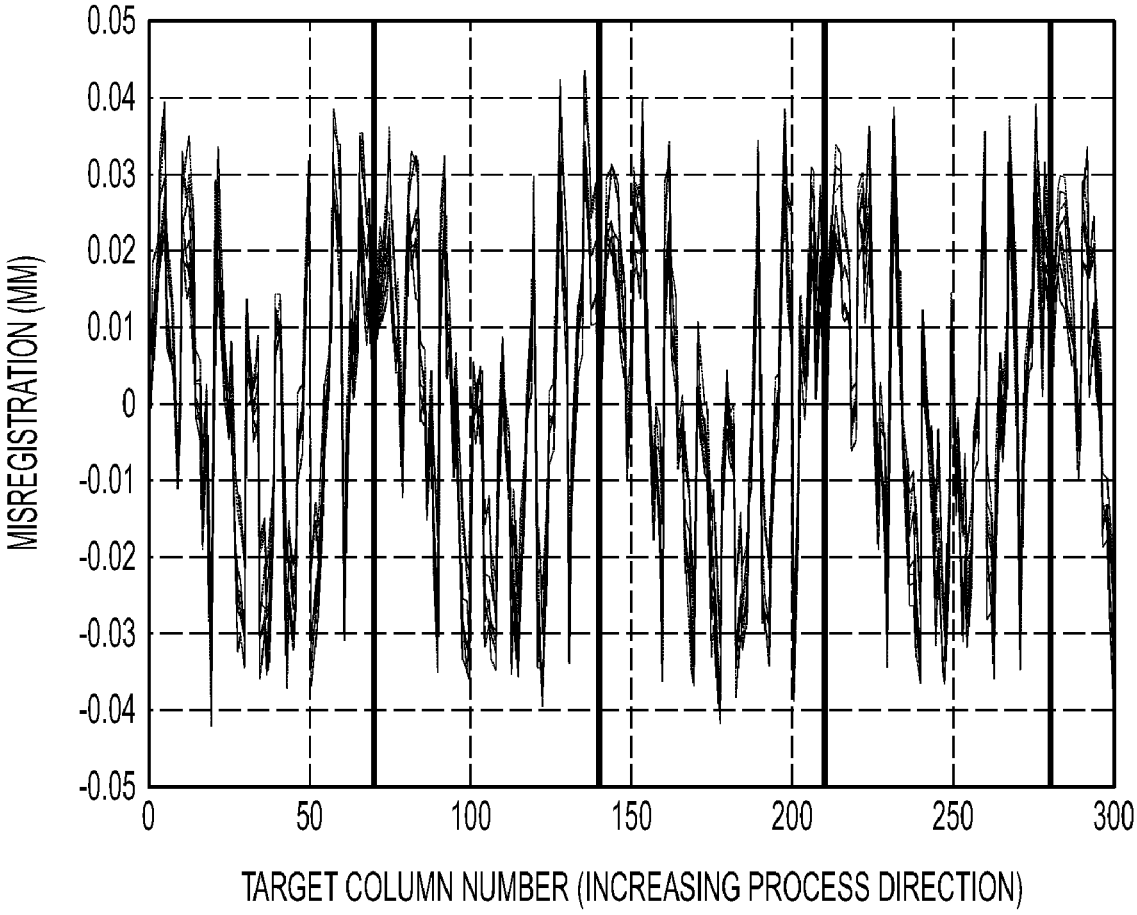

With reference to FIG. 9B, another exemplary set of process-direction C-K registration measurements for the selected target media in the exemplary multicolor marking system may be plotted as a plurality of curves in a graph. The vertical axis of the graph may be the same as for FIG. 9A. The horizontal axis may reflect that 300 test pattern images were scanned in relation to the 30 sheets of selected target media. In this exemplary embodiment, a test pattern image array comprising nine rows and ten columns was marked for each sheet of selected target media and seven sheets of the selected target media were marked in each revolution of a PR belt. Each curve of process direction C-K registration measurements being based at least in part on the cross-process position of a corresponding row of test pattern images and the process position of each column. Notably, the resulting measurements reflect a C-K registration error pattern that is similar for each column and repeated for each group of seven sheets (i.e., PR belt revolution). Similarly, process direction M-K and Y-K registration measurements may be obtained and plotted in the same manner as the process direction C-K registration error plot.

In the embodiment being described, a plurality of cross-process C-K registration measurements may be obtained and plotted in similar fashion to that described above for the process direction C-K registration error plot. The cross-process C-K registration measurements being based at least in part on the cross-process position of a corresponding row of test pattern images and the process position of each column. Similarly, cross-process M-K and Y-K registration measurements may be obtained and plotted in the same manner as the cross-process C-K registration error plot.

Color-to-color registration measurements for a selected target media in an exemplary multicolor marking system from the scanning of a test pattern image array having multiple rows (e.g., see multiple curves in FIG. 9B) may be processed to determine an ensemble average of the corresponding registration error. Repeatable or cyclic registration error may be used by a controller for the marking system for higher-order error correction during the marking of subsequent jobs. The controller may utilize electronic registration techniques (e.g., image warping), mechanical adjustments (e.g., belt or feeder subsystem speed), or any suitable combination thereof to reduce the color registration error for the subsequent job.

Figure 10A:
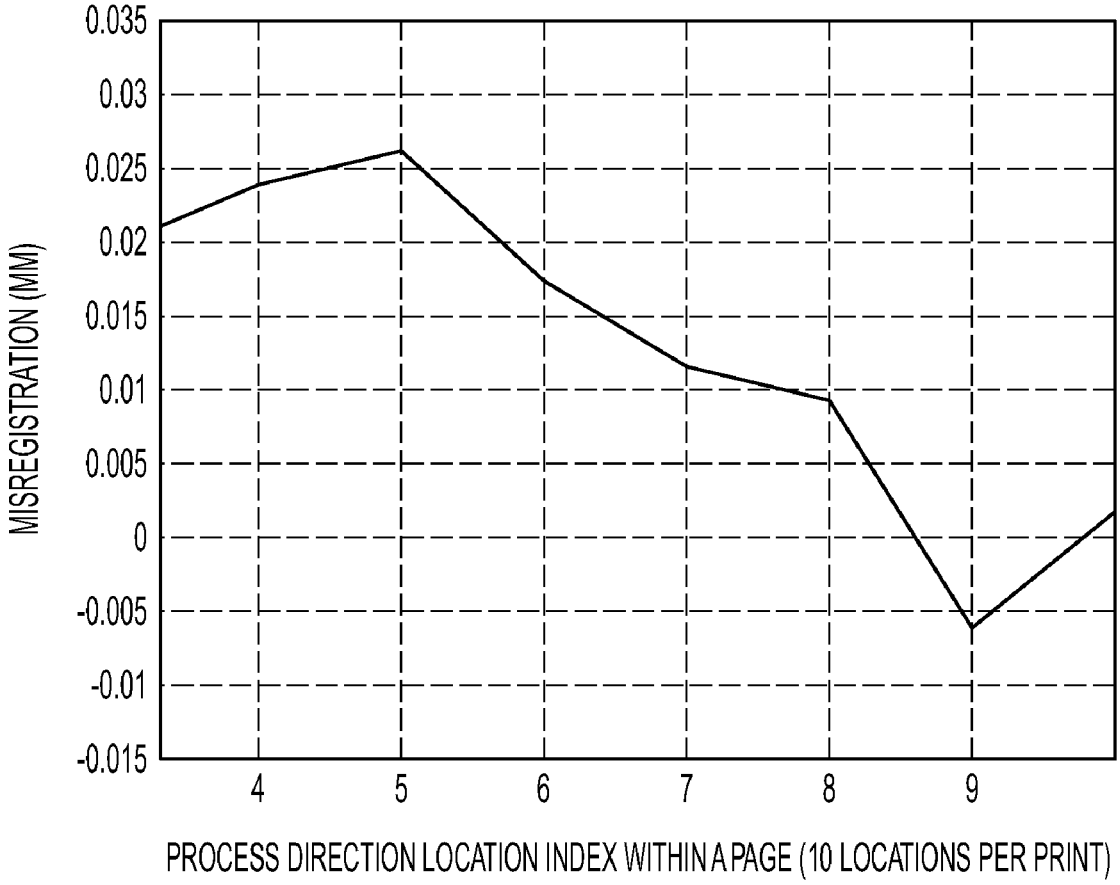
FIGS. 10A and 10B are charts showing examples of average color registration measurements in relation to process direction.

With reference to FIG. 10A, an ensemble average of process direction C-K registration measurements for one sheet of a selected target media in an exemplary multicolor marking system from the scanning of a test pattern image array having multiple rows is shown. If this ensemble average process-direction C-K registration error is a repeatable pattern over each sheet for the selected target media, the controller for the marking system may utilize the ensemble average to repeatedly adjust the C registration during the marking of each sheet of the selected target media in subsequent marking jobs.

Similarly, an ensemble average for cross-process C-K registration measurements may be determined and used to adjust the C registration during the marking of each sheet of the selected target media in subsequent marking jobs. Of course, process and cross-process ensemble averages can be used in combination to adjust the C registration. Likewise, ensemble averages for process direction and cross-process M-K and Y-K registration measurements may be determined and used to adjust M and Y registration in the same manner as described above for C registration.

Figure 10B:
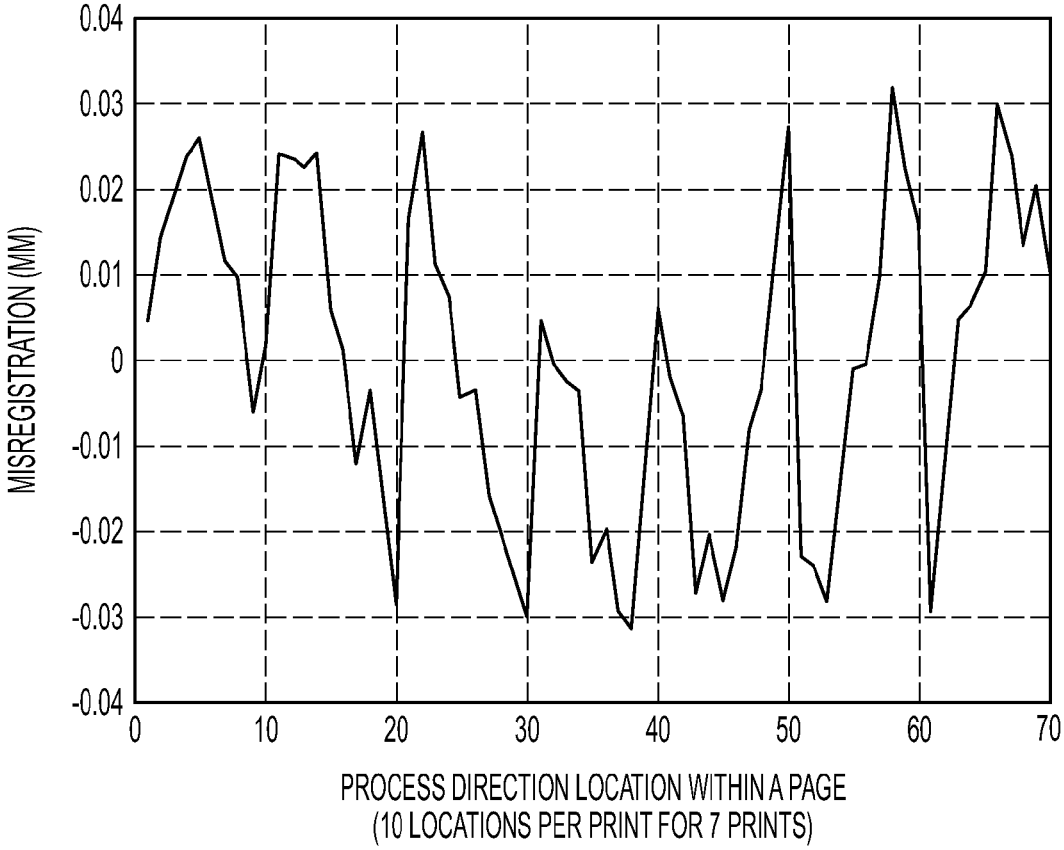

With reference to FIG. 10B, an ensemble average of process direction C-K registration measurements for multiple sheets of a selected target media in an exemplary multicolor marking system from the scanning of a test pattern image array having multiple rows is shown. In the embodiment being described, seven sheets of the selected target media were marked in each revolution of a PR belt of the marking system. If this ensemble average process-direction C-K registration error is a repeatable pattern over each revolution of the PR belt for the selected target media, the controller for the marking system may utilize the ensemble average to repeatedly adjust the C registration during the marking of each seven sheets of the selected target media in subsequent marking jobs.

Similarly, an ensemble average for cross-process C-K registration measurements may be determined and used to adjust the C registration during the marking of each seven sheets of the selected target media in subsequent marking jobs. Of course, process and cross-process ensemble averages can be used in combination to adjust the C registration. Likewise, ensemble averages for process direction and cross-process M-K and Y-K registration measurements may be determined and used to adjust M and Y registration in the same manner as described above for C registration.

With reference to FIGS. 10A and 10B, the individual registration measurements for the test pattern arrays can be averaged over multiple repeatable or cyclic patterns of registration error. For example, the ensemble average for C-K registration error can be based at least in part on two or more belt revolutions (e.g., see FIG. 9B, x-axis 1-70 (first revolution), x-axis 71-140 (second revolution), x-axis 141-210 (third revolution), and x-axis 211-280 (fourth revolution)). Moreover, this type of ensemble averaging for repeatable registration error over each belt revolution can incorporate repeatable or cyclic patterns that occur at higher frequencies, such as from page to page. Thus, the curve in FIG. 10B shows a repeatable ensemble average for C-K registration error for each group of seven selected target media pages printer during each belt revolution and incorporates any registration error that is repeatable for each page, such as is shown in FIG. 10A.

As discussed above, the ensemble average registration error can vary in relation to the process direction and individual measurements in relation to each column within the test pattern image array. If the array includes multiple rows, the ensemble average for each column can be determined by averaging the corresponding measurements from each row. This can be accomplished by simply dividing the sum of the corresponding measurements from each row by the quantity of rows. Alternatively, any suitable averaging algorithm may be used to obtain the ensemble average for each column. For example, a mean-squared error (MSE) algorithm may be used to determine the ensemble error. For additional information on the MSE algorithm, see U.S. patent application Ser. No. 12/251,808. After a repeatable registration error pattern is defined, the ensemble average can be determined from averaging the registration measurements of corresponding columns from multiple passes through the repeatable pattern. In other words, the ensemble average registration error for the first column of test pattern images in a seven sheet repeatable pattern can be determined by averaging the measurements from each row for the first column of the first page and the first column of the eighth page. Smoothing or interpolation algorithms can also be applied to the curve defining the repeatable pattern for the ensemble average registration error.

The repeatable registration error patterns can be used as higher-order mappings of color registration errors that can be corrected for, for example, using an electronic registration algorithm with image warping techniques at a suitable frequency higher than the highest frequency of interest. Correction of repeatable registration error patterns can result in residual registration errors that are lower than the pre-correction error and lower than correction of DC error. For example, if an electronic registration algorithm and image warping techniques are used, the residual registration errors may be significantly lower because of higher frequency response rates to varying color-to-color registration within target media sheets and from sheet-to-sheet during a given marking job.

Figure 11:
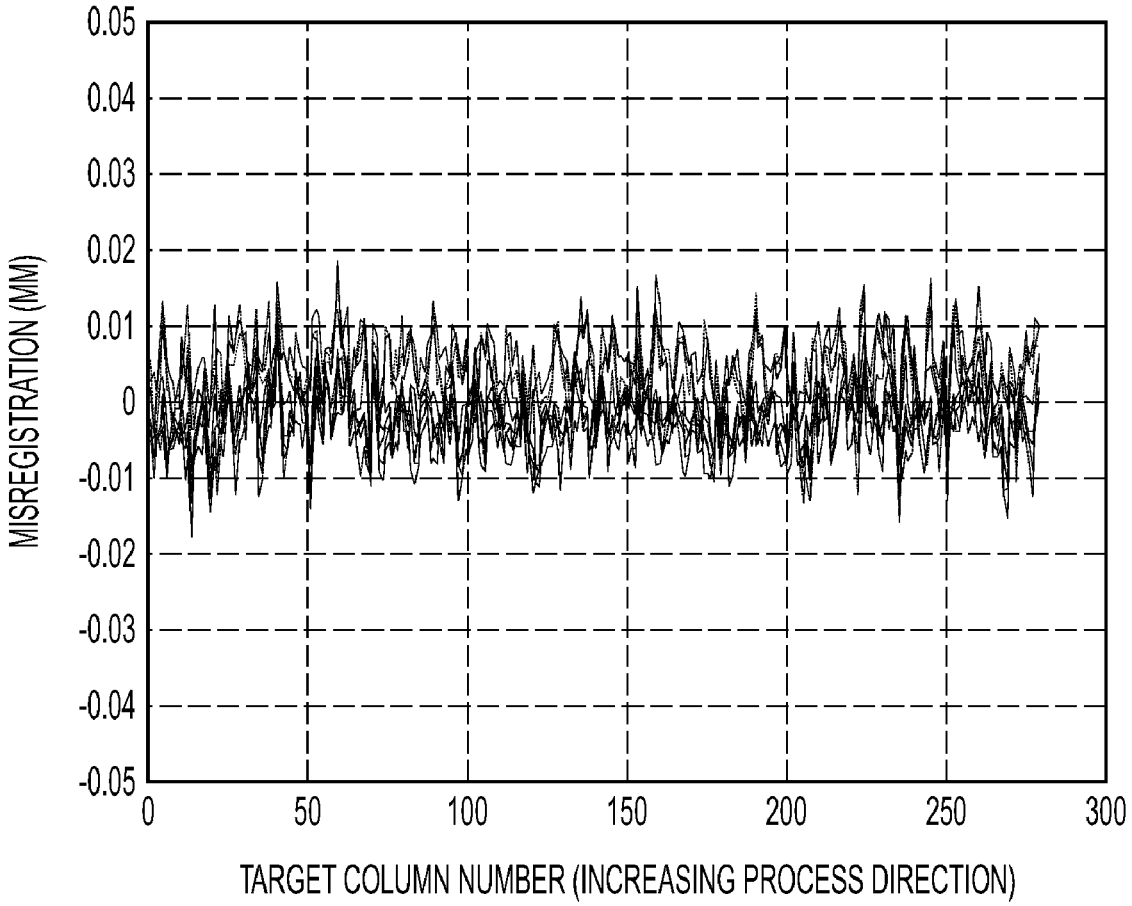
FIG. 11 is a chart showing an example of residual color registration measurements after performing an error correction process based on previous color registration measurements.

With reference to FIG. 11, an exemplary residual process direction C-K registration error results after using an electronic registration algorithm with image warping techniques to correct for the repeatable C-K registration error pattern of FIG. 10 is shown. In comparison to FIG. 9B, the maximum C-K registration error is reduced from approximately ±43 microns to approximately ±17 microns. This reflects a reduction of approximately 16 microns in the maximum C-K registration error. In this example, the average C-K registration error is reduced from approximately ±15 microns to approximately ±4 microns.

Figure 12A:
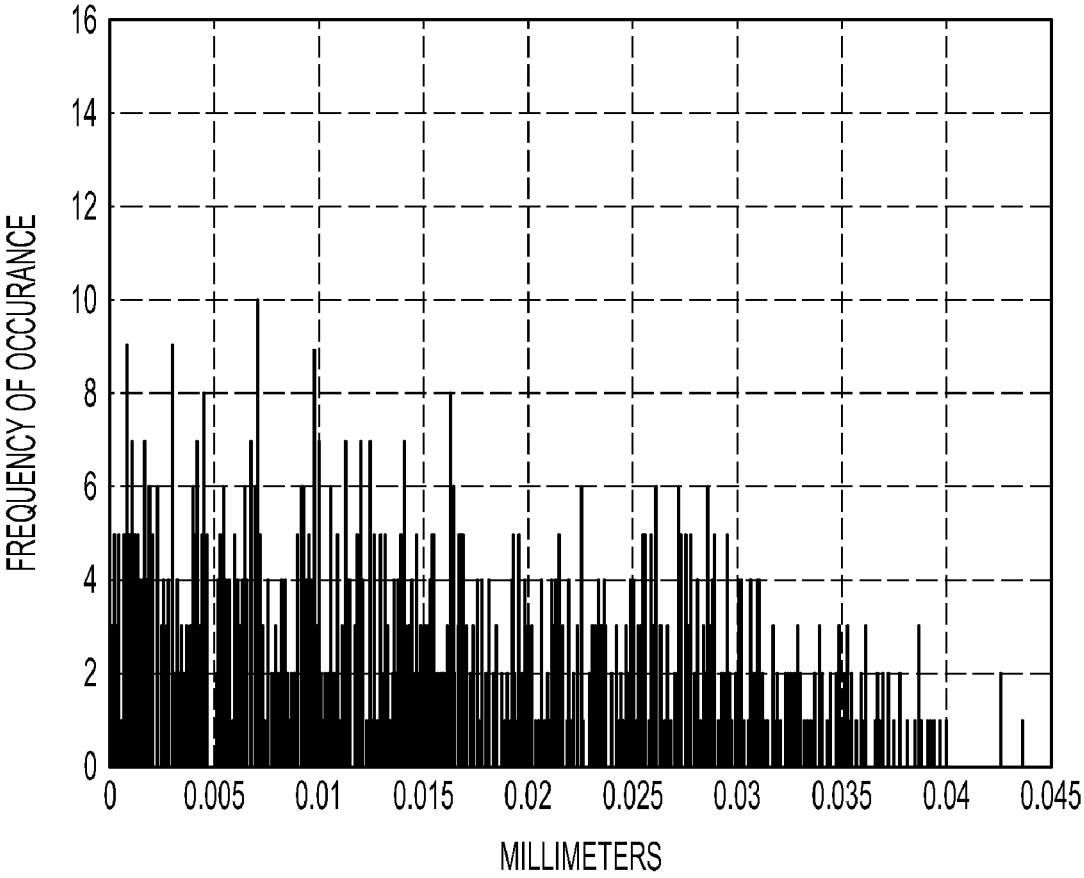
FIGS. 12A and 12B are histograms showings examples of previous color registration measurements and residual color registration measurements after performing an error correction process based on the previous color registration measurements.
Figure 12B:
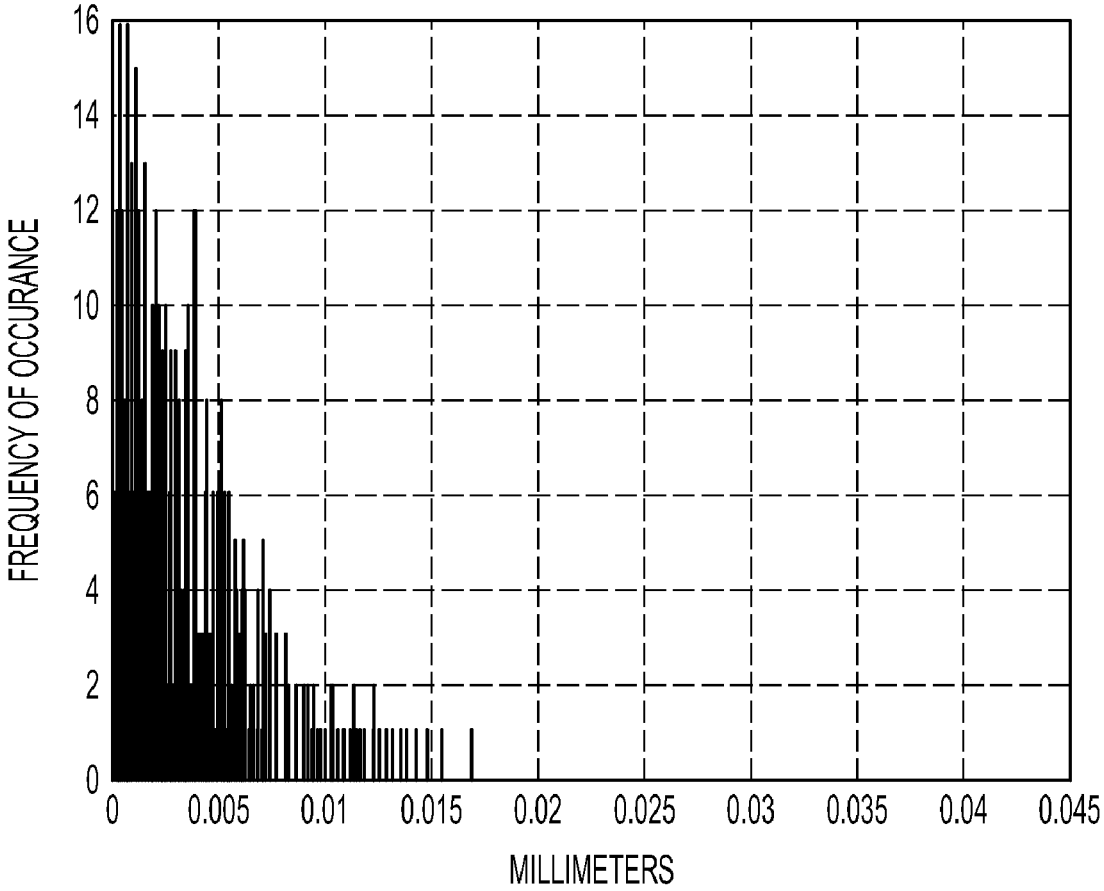

With reference to FIG. 12A, a histogram showing the absolute value for the original C-K registration error is shown. The absolute value for the residual C-K registration error after electronic registration correction processing based at least in part on the repeatable C-K registration error pattern is shown in FIG. 12B.

Figure 13:
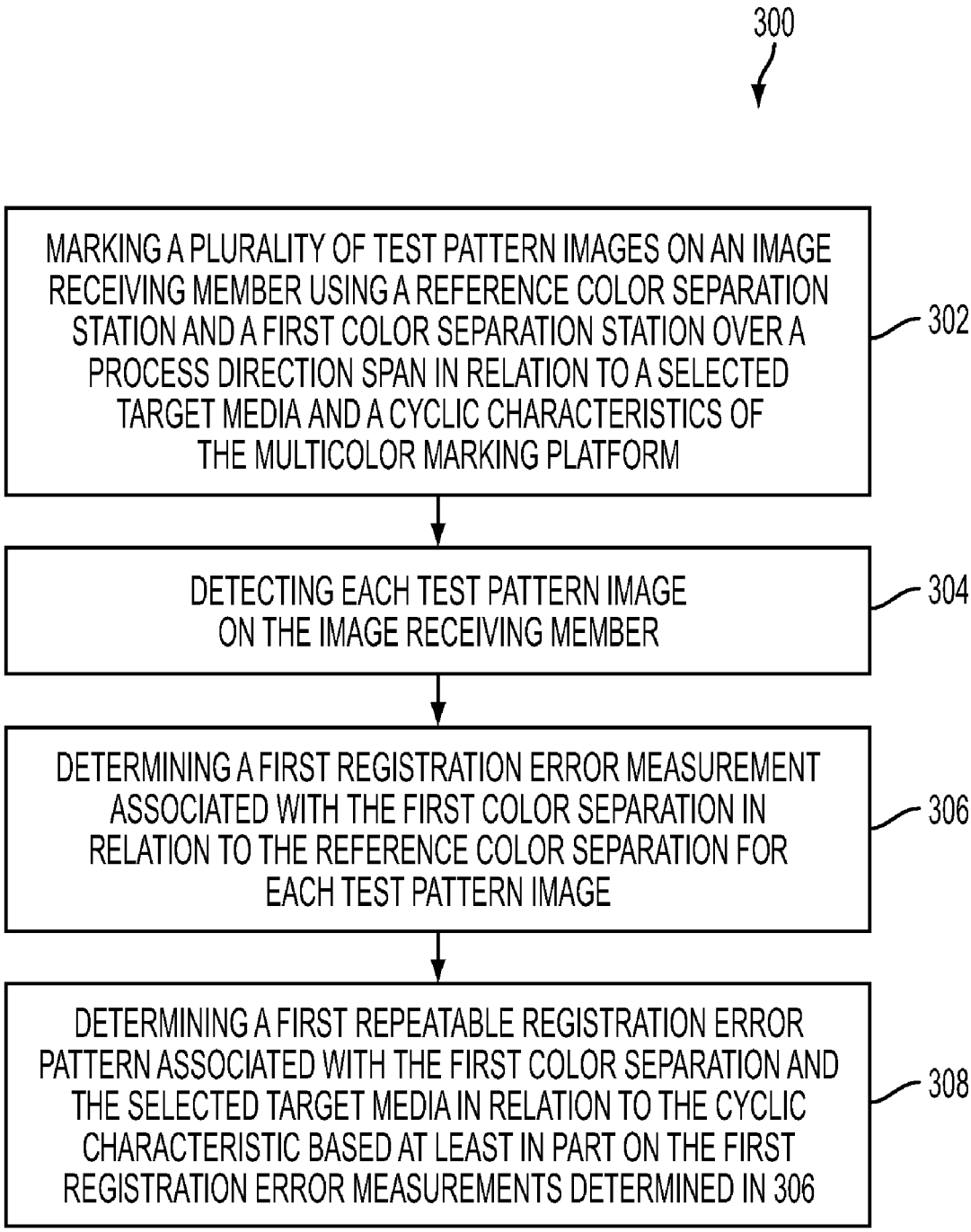
FIG. 13 is a flowchart of an exemplary embodiment of a process for measuring color-to-color registration in a multicolor marking platform.

With reference to FIG. 13, an exemplary embodiment of a process 300 for measuring color-to-color registration in a multicolor marking platform begins at 302 with the marking of a plurality of test pattern images on an image receiving member using a reference color separation station and a first color separation station over a process direction span in relation to a selected target media and a cyclic characteristic of the multicolor marking platform. At 304, each test pattern image on the image receiving member is detected. Next, a first registration measurement associated with the first color separation in relation to the reference color separation is determined for each test pattern image (306). In one embodiment, the first registration measurements provide process measurements or cross-process measurements for the first color separation. In another embodiment, the first registration measurements provide cross-process measurements for the first color separation. At 308, a first repeatable registration error pattern associated with the first color separation and the selected target media in relation to the cyclic characteristic is determined based at least in part on the first registration measurements determined in 306.

In another embodiment, the process 300 may include marking the plurality of test pattern images on the image receiving member over a cross-process direction span in relation to the selected target media. This embodiment may further include averaging first registration measurements for test pattern images positioned in cross-process direction relation during the determining in 308. Alternatively, where the process direction span for the marking in 302 continues for a plurality of cycles in relation to the cyclic characteristic, this embodiment may include averaging first registration measurements for test pattern images positioned in cyclic relation with respect to absolute cross-process direction for the cyclic characteristic during the determining in 308.

In still another embodiment, each test pattern image may be indicative of both process direction registration and cross-process registration of the first color separation in relation to the reference color separation. In this embodiment, the process 300 may include determining a second registration measurement associated with the first color separation in relation to the reference color separation for each test pattern image. The first and second registration measurements provide both process and cross-process measurements for the first color separation. A second repeatable registration error pattern associated with the first color separation and the selected target media in relation to the cyclic characteristic may be determined based at least in part on the determined second registration measurements.

In yet another embodiment, the plurality of test pattern images may be arranged in at least one array. Each array may include at least one row extending along the process direction span and a plurality of columns extending along a cross-process direction span. A quantity of columns for each array may be based at least in part on a size dimension for the selected target media in relation to the process direction. In this embodiment, each array may include a plurality of rows extending along the process direction. A quantity of rows for each array may be based at least in part on a size dimension for the selected target media in relation to the cross-process direction.

In one embodiment, the cyclic characteristic may be cyclic in relation to marking each sheet of the selected target media. In another embodiment, the cyclic characteristic may be cyclic in relation to a revolution of a belt associated with the marking platform and adapted to transfer marking material from the color separation stations to the selected target media. In this embodiment, the cyclic characteristic may be cyclic in relation to marking a plurality of consecutive sheets of the selected target media marked during each revolution of the belt. In yet another embodiment, the image receiving member may include one or more sheets of the selected target media.

In still another embodiment, the process 300 may include using a second color separation station and a third color separation station for the marking of the plurality of test pattern in 302. A second registration measurement associated with the second color separation in relation to the reference color separation may be determined for each test pattern image. In one embodiment, the second registration measurements provide process measurements for the second color separation. In another embodiment, the second registration measurements provide cross-process measurements for the second color separation. The process 300 may continue with determining a second repeatable registration error pattern associated with the second color separation and the selected target media in relation to the cyclic characteristic based at least in part on the determined second registration measurements.

In the embodiment being described, the process 300 may include determining a third registration measurement associated with the third color separation in relation to the reference color separation for each test pattern image. In one embodiment, the third registration measurements provide process measurements for the third color separation. In another embodiment, the third registration measurements provide cross-process measurements for the third color separation. The process 300 may continue with determining a third repeatable registration error pattern associated with the third color separation and the selected target media in relation to the cyclic characteristic based at least in part on the determined third registration measurements determined.

In the embodiment being described, each test pattern image may be indicative of process direction registration and cross-process registration of the first, second, and third color separations in relation to the reference color separation. In this embodiment, the process 300 may include determining a fourth registration measurement associated with the first color separation in relation to the reference color separation for each test pattern image. The first and fourth registration measurements may provide process and cross-process measurements for the first color separation. A fourth repeatable registration error pattern associated with the first color separation and the selected target media in relation to the cyclic characteristic may be determined based at least in part on the determined fourth registration measurements. The process 300 may include determining a fifth registration measurement associated with the second color separation in relation to the reference color separation for each test pattern image. The second and fifth registration measurements may provide process and cross-process measurements for the second color separation. A fifth repeatable registration error pattern associated with the second color separation and the selected target media in relation to the cyclic characteristic may be determined based at least in part on the determined fifth registration measurements.

The embodiment being described may include determining a sixth registration measurement associated with the third color separation in relation to the reference color separation for each test pattern image. The third and sixth registration measurements provide process and cross-process measurements for the third color separation. A sixth repeatable registration error pattern associated with the third color separation and the selected target media in relation to the cyclic characteristic may be determined based at least in part on the determined sixth registration measurements.

Figure 14:
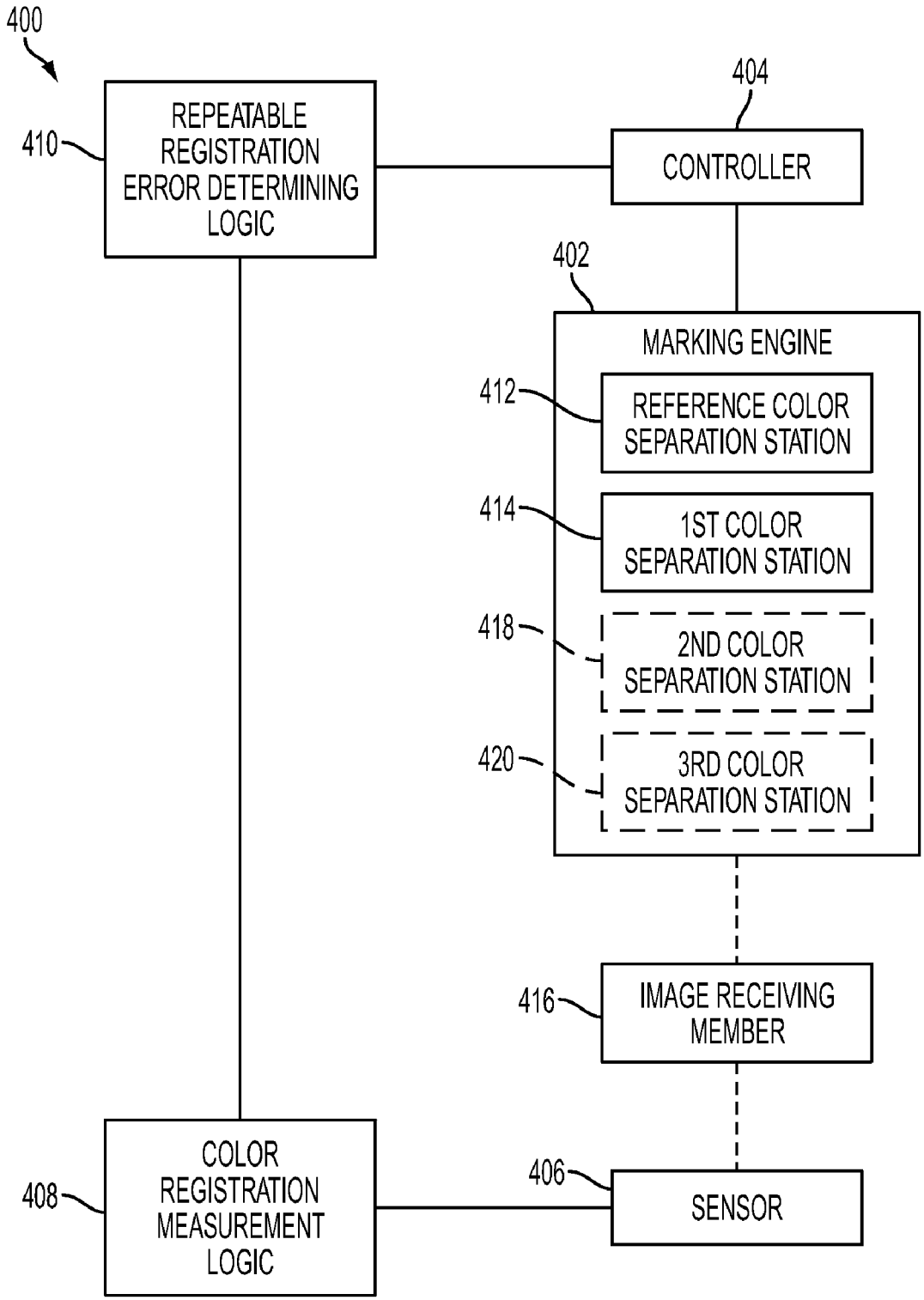
FIG. 14 is a block diagram of an exemplary embodiment of a system for measuring color-to-color registration in a multicolor marking platform.

With reference to FIG. 14, an exemplary embodiment of a multicolor marking platform 400 may include a marking engine 402, a controller 404, a sensor 406, a color registration measurement logic 408, and a repeatable registration error determining logic 410. The marking engine 402 may include a reference color separation station 412 and a first color separation station 414. The controller 404 may selectively mark a plurality of test pattern images on an image receiving member 416 over a process direction span using the reference color separation station 412 and the first color separation station 414 in relation to a selected target media and a cyclic characteristic of the multicolor marking platform 400. The sensor 406 may detect each test pattern image on the image receiving member 416. The color registration measurement logic 408 may determine a first registration measurement associated with the first color separation in relation to the reference color separation for each test pattern image. In one embodiment, the first registration measurements provide process measurements for the first color separation. In another embodiment, the first registration measurements provide cross-process measurements for the first color separation. The repeatable registration error determining logic 410 may determine a first repeatable registration error pattern associated with the first color separation and the selected target media in relation to the cyclic characteristic based at least in part on the first registration measurements determined by the color registration measurement logic 408. In various embodiments, the multicolor marking platform 400 may be an electrophotographic marking system, a xerographic marking system, an ink marking system, an inkjet marking system, a printing press, an offset printing press, a printer, a copier, or a multifunction device. The various components of the multicolor marking platform 400 disclosed herein may be implemented using hardware, software, or firmware in any suitable combination.

In one embodiment, the controller 404 may selectively mark the plurality of test pattern images on the image receiving member 416 over a cross-process direction span in relation to the selected target media. In this embodiment, the repeatable registration error determining logic 410 may average the first registration measurements for test pattern images positioned in cross-process direction relation during the determining of the first repeatable registration error pattern. Alternatively, where the controller 404 selectively marks the plurality of test pattern images in the process direction span for a plurality of cycles in relation to the cyclic characteristic, the repeatable registration error determining logic 410 may average the first registration measurements for test pattern images positioned in cyclic relation with respect to absolute cross-process direction for the cyclic characteristic during the determining of the first repeatable registration error pattern.

In another embodiment, each test pattern image is indicative of process direction registration and cross-process registration of the first color separation in relation to the reference color separation. In this embodiment, the color registration measurement logic 408 may determine a second registration measurement associated with the first color separation in relation to the reference color separation for each test pattern image. The first and second registration measurements may provide process and cross-process measurements for the first color separation. In the embodiment being described, the repeatable registration error determining logic 410 may determine a second repeatable registration error pattern associated with the first color separation and the selected target media in relation to the cyclic characteristic based at least in part on the second registration measurements determined by the color registration measurement logic 408.

In yet another embodiment, the marking engine 402 may include a belt to transfer marking material from the color separation stations to the selected target media. In this embodiment, the cyclic characteristic is cyclic in relation to a revolution of the belt. The image receiving member 416 may include the belt.

In still another embodiment, the marking engine may include a second color separation station 418 and a third color separation station 420. In this embodiment, the controller 404 may selectively mark the plurality of test pattern images on the image receiving member using the second and third color separation stations. The color registration measurement logic 408 may determine a second registration measurement associated with the second color separation in relation to the reference color separation for each test pattern image. In one embodiment, the second registration measurements may provide process measurements for the second color separation. In another embodiment, the second registration measurements may provide cross-process measurements for the second color separation. The repeatable registration error determining logic 410 may determine a second repeatable registration error pattern associated with the second color separation and the selected target media in relation to the cyclic characteristic based at least in part on the second registration measurements determined by the color registration measurement logic 408.

In the embodiment being described, the color registration measurement logic 408 may determine a third registration measurement associated with the third color separation in relation to the reference color separation for each test pattern image. In one embodiment, the third registration measurements may provide process measurements for the third color separation. In another embodiment, the third registration measurements may provide cross-process measurements for the third color separation. The repeatable registration error determining logic 410 may determine a third repeatable registration error pattern associated with the third color separation and the selected target media in relation to the cyclic characteristic based at least in part on the third registration measurements determined by the color registration measurement logic 408.

Figure 15:
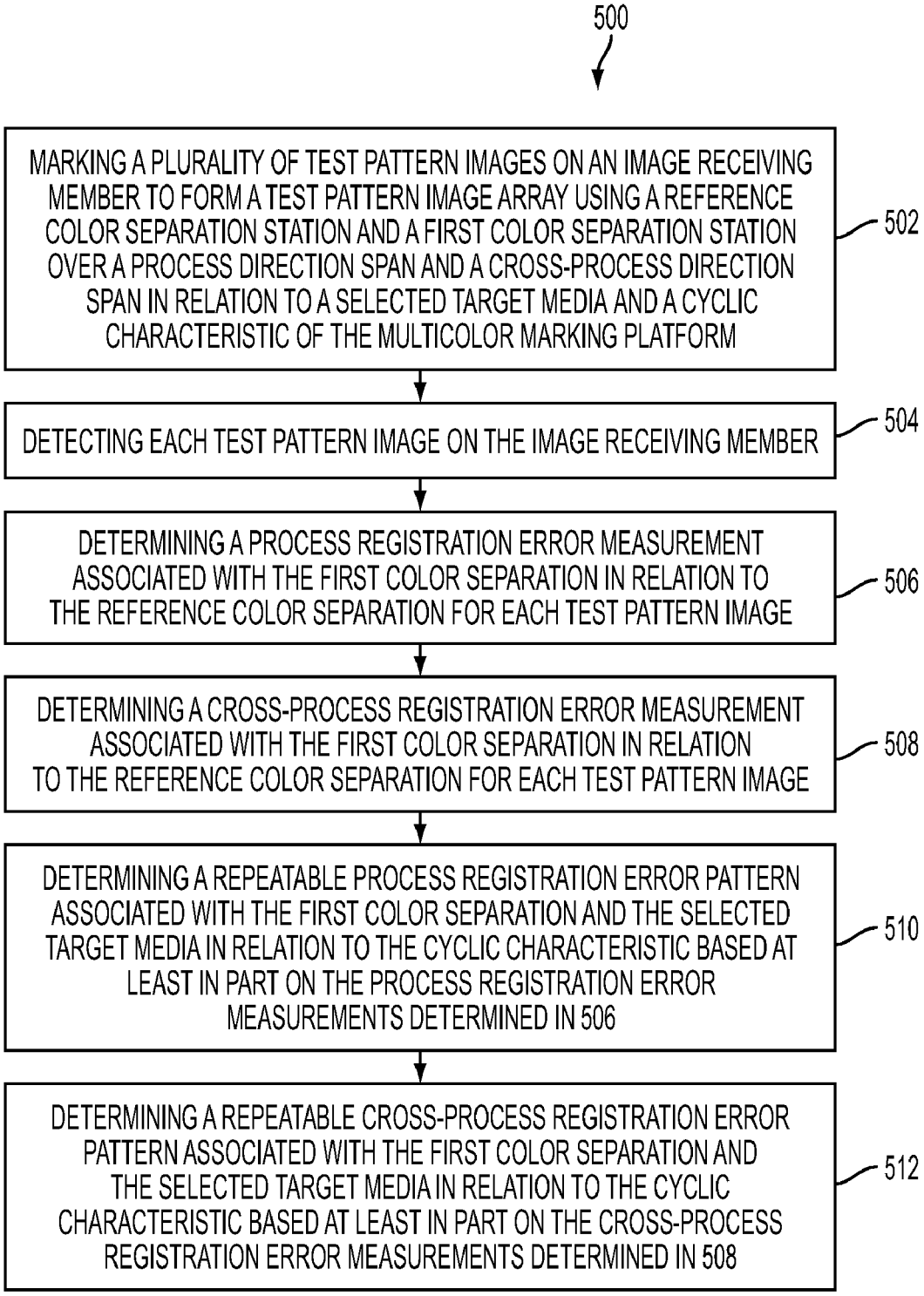
FIG. 15 is a flowchart of another exemplary embodiment of a process for measuring color-to-color registration in a multicolor marking platform.

With reference to FIG. 15, an exemplary embodiment of a process 500 for measuring color-to-color registration in a multicolor marking platform begins at 502 with the marking a plurality of test pattern images on an image receiving member to form a test pattern image array using a reference color separation station and a first color separation station over a process direction span and a cross-process direction span in relation to a selected target media and a cyclic characteristic of the multicolor marking platform. At 504, each test pattern image on the image receiving member is detected. Next, a process registration measurement associated with the first color separation in relation to the reference color separation is determined for each test pattern image (506). At 508, a cross-process registration measurement associated with the first color separation in relation to the reference color separation is determined for each test pattern image. At 510, a repeatable process registration error pattern associated with the first color separation and the selected target media in relation to the cyclic characteristic is determined based at least in part on the process registration measurements determined in 506. At 512, a repeatable cross-process registration error pattern associated with the first color separation and the selected target media in relation to the cyclic characteristic is determined based at least in part on the cross-process registration measurements determined in 508.

In another embodiment, the process 500 may include averaging process registration measurements for test pattern images positioned in cross-process direction relation during the determining in 510. In this embodiment, the process 500 may further include averaging first cross-process registration measurements for test pattern images positioned in cross-process direction relation during the determining in 512.

In still another embodiment, the process direction span for the marking in 502 may continue for a plurality of cycles in relation to the cyclic characteristic. In this embodiment, the process 500 may include averaging process registration measurements for test pattern images positioned in cyclic relation with respect to absolute cross-process direction for the cyclic characteristic during the determining in 510. Similarly, cross-process registration measurements for test pattern images positioned in cyclic relation with respect to absolute cross-process direction for the cyclic characteristic may be averaged during the determining in 512.

In summary, color-to-color registration in a multicolor marking system may be measured for at least one of a process direction and a cross-process direction. The measurement may be performed by marking and scanning a plurality of color-to-color test pattern images arranged in an array on an image receiving member. The scanning may be accomplished using a sensor, such as an full-width array sensor. One or more repeatable color registration error patterns may be determined from the registration measurements. The color registration error in subsequent marking jobs may be reduced using an electronic registration error correction algorithm based at least in part on the repeatable color registration error pattern. This method for color-to-color registration may be implemented for xerographic printing, inkjet printing, and similar marking techniques that use multiple colors.

It will be appreciated that various above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

The invention claimed is:

1. A method of measuring color-to-color registration in a multicolor marking platform, comprising:

a) marking a plurality of test pattern images on an image receiving member using a reference color separation station and a first color separation station over a process direction span in relation to a selected target media and a cyclic characteristic of the multicolor marking platform, wherein the plurality of test pattern images are arranged in at least one array, each array comprising at least one row extending along the process direction span and a plurality of columns, each column extending along a cross-process direction span, a quantity of columns and a quantity of rows for each array based at least in part on a size dimension for the selected target media in the process direction and in the cross-process direction respectively;

b) detecting each test pattern image on the image receiving member;

c) determining a first registration measurement associated with the first color separation in relation to the reference color separation for each test pattern image, wherein the first registration measurements provide process measurements for the first color separation; and d) determining a first repeatable registration error pattern associated with the first color separation and the selected target media in relation to the cyclic characteristic based at least in part on the first registration measurements determined in c), wherein the first registration measurements associated with each column of one or more test patterns are represented in the first repeatable registration error pattern such that column-level resolution is provided for the first repeatable registration error pattern in the process direction.

2. The method set forth in claim 1, further comprising:

e) marking the plurality of test pattern images on the image receiving member over a cross-process direction span in relation to the selected target media.

3. The method set forth in claim 2, further comprising:

f) averaging first registration measurements for test pattern images positioned in cross-process direction relation during the determining in d).

4. The method set forth in claim 2 wherein the process direction span for the marking in a) continues for a plurality of cycles in relation to the cyclic characteristic, further comprising:

f) averaging first registration measurements for test pattern images positioned in cyclic relation with respect to absolute cross-process direction for the cyclic characteristic during the determining in d).

5. The method set forth in claim 1 wherein each test pattern image is indicative of process direction registration and cross-process registration of the first color separation in relation to the reference color separation, further comprising:

e) determining a second registration measurement associated with the first color separation in relation to the reference color separation for each test pattern image, wherein the second registration measurements provide cross-process measurements for the first color separation; and f) determining a second repeatable registration error pattern associated with the first color separation and the selected target media in relation to the cyclic characteristic based at least in part on the second registration measurements determined in e).

6. The method set forth in claim 1 wherein each array includes a plurality of rows extending along the process direction, a quantity of rows for each array based at least in part on a size dimension for the selected target media in relation to the cross-process direction.

7. The method set forth in claim 1 wherein the cyclic characteristic is cyclic in relation to marking each sheet of the selected target media.

8. The method set forth in claim 1 wherein the cyclic characteristic is cyclic in relation to a revolution of a belt associated with the marking platform and adapted to transfer marking material from the color separation stations to the selected target media.

9. The method set forth in claim 8 wherein the cyclic characteristic is cyclic in relation to marking a plurality of consecutive sheets of the selected target media marked during each revolution of the belt.

10. The method set forth in claim 1, further comprising:

e) using a second color separation station and a third color separation station for the marking of the plurality of test pattern in a);

f) determining a second registration measurement associated with the second color separation in relation to the reference color separation for each test pattern image, wherein the second registration measurements provide process measurements for the second color separation;

g) determining a second repeatable registration error pattern associated with the second color separation and the selected target media in relation to the cyclic characteristic based at least in part on the second registration measurements determined in f);

h) determining a third registration measurement associated with the third color separation in relation to the reference color separation for each test pattern image, wherein the third registration measurements provide one of process measurements for the third color separation; and i) determining a third repeatable registration error pattern associated with the third color separation and the selected target media in relation to the cyclic characteristic based at least in part on the third registration measurements determined in h).

11. The method set forth in claim 10 wherein each test pattern image is indicative of process direction registration and cross-process registration of the first, second, and third color separations in relation to the reference color separation, further comprising:

j) determining a fourth registration measurement associated with the first color separation in relation to the reference color separation for each test pattern image, wherein the fourth registration measurements provide cross-process measurements for the first color separation;

k) determining a fourth repeatable registration error pattern associated with the first color separation and the selected target media in relation to the cyclic characteristic based at least in part on the fourth registration measurements determined in j);

l) determining a fifth registration measurement associated with the second color separation in relation to the reference color separation for each test pattern image, wherein fifth registration measurements provide cross-process measurements for the second color separation;

m) determining a fifth repeatable registration error pattern associated with the second color separation and the selected target media in relation to the cyclic characteristic based at least in part on the fifth registration measurements determined in l);

n) determining a sixth registration measurement associated with the third color separation in relation to the reference color separation for each test pattern image, wherein the sixth registration measurements provide cross-process measurements for the third color separation; and o) determining a sixth repeatable registration error pattern associated with the third color separation and the selected target media in relation to the cyclic characteristic based at least in part on the sixth registration measurements determined in n).

12. The method set forth in claim 1 wherein the image receiving member includes one or more sheets of the selected target media.

13. An apparatus for measuring color-to-color registration in a multicolor marking platform, comprising:

a marking engine with a reference color separation station and a first color separation station;

a controller in operative communication with the marking engine to selectively mark a plurality of test pattern images on an image receiving member over a process direction span using the reference color separation station and the first color separation station in relation to a selected target media and a cyclic characteristic of the multicolor marking platform, wherein the plurality of test pattern images are arranged in at least one array, each array comprising at least one row extending along the process direction span and a plurality of columns, each column extending along a cross-process direction span, a quantity of columns and a quantity of rows for each array based at least in part on a size dimension for the selected target media in the process direction and the cross-process direction respectively;

a sensor in operative communication with the controller to detect each test pattern image on the image receiving member;

a color registration measurement logic in operative communication with the sensor and controller to determine a first registration measurement associated with the first color separation in relation to the reference color separation for each test pattern image, the first registration measurements providing process measurements for the first color separation; and a repeatable registration error determining logic in operative communication with the color registration measurement logic and the controller to determine a first repeatable registration error pattern associated with the first color separation and the selected target media in relation to the cyclic characteristic based at least in part on the first registration measurements determined by the color registration measurement logic, wherein the first registration measurements associated with each column of one or more test patterns are represented in the first repeatable registration error pattern such that column-level resolution is provided for the first repeatable registration error pattern in the process direction.

14. The apparatus set forth in claim 13 wherein the controller selectively marks the plurality of test pattern images on the image receiving member over a cross-process direction span in relation to the selected target media.

15. The apparatus set forth in claim 14 wherein the repeatable registration error determining logic averages the first registration measurements for test pattern images positioned in cross-process direction relation during the determining of the first repeatable registration error pattern.

16. The apparatus set forth in claim 14 wherein the controller selectively marks the plurality of test pattern images in the process direction span for a plurality of cycles in relation to the cyclic characteristic; and wherein the repeatable registration error determining logic averages the first registration measurements for test pattern images positioned in cyclic relation with respect to absolute cross-process direction for the cyclic characteristic during the determining of the first repeatable registration error pattern.

17. The apparatus set forth in claim 13 wherein each test pattern image is indicative of process direction registration and cross-process registration of the first color separation in relation to the reference color separation;

wherein the color registration measurement logic determines a second registration measurement associated with the first color separation in relation to the reference color separation for each test pattern image, the second registration measurements providing cross-process measurements for the first color separation; and wherein the repeatable registration error determining logic determines a second repeatable registration error pattern associated with the first color separation and the selected target media in relation to the cyclic characteristic based at least in part on the second registration measurements determined by the color registration measurement logic.

18. The apparatus set forth in claim 13, the marking engine further comprising:

a belt to transfer marking material from the color separation stations to the selected target media, wherein the cyclic characteristic is cyclic in relation to a revolution of the belt.

19. The apparatus set forth in claim 18 wherein the image receiving member includes the belt.

20. The apparatus set forth in claim 13, the marking engine further comprising:

a second color separation station; and a third color separation station;

wherein the controller selectively marks the plurality of test pattern images on the image receiving member using the second and third color separation stations;

wherein the color registration measurement logic determines a second registration measurement associated with the second color separation in relation to the reference color separation for each test pattern image, the second registration measurements providing process measurements for the second color separation;

wherein the repeatable registration error determining logic determines a second repeatable registration error pattern associated with the second color separation and the selected target media in relation to the cyclic characteristic based at least in part on the second registration measurements determined by the color registration measurement logic;

wherein the color registration measurement logic determines a third registration measurement associated with the third color separation in relation to the reference color separation for each test pattern image, the third registration measurements providing process measurements for the third color separation; and wherein the repeatable registration error determining logic determines a third repeatable registration error pattern associated with the third color separation and the selected target media in relation to the cyclic characteristic based at least in part on the third registration measurements determined by the color registration measurement logic.

21. The apparatus set forth in claim 13 wherein the multicolor marking platform is at least one of an electrophotographic marking system, a xerographic marking system, an ink marking system, an inkjet marking system, a printing press, an offset printing press, a printer, a copier, and a multifunction device.

22. A method of measuring color-to-color registration in a multicolor marking platform, comprising:

a) marking a plurality of test pattern images on an image receiving member to form a test pattern image array using a reference color separation station and a first color separation station over a process direction span and a cross-process direction span in relation to a selected target media and a cyclic characteristic of the multicolor marking platform, wherein the plurality of test pattern images are arranged in at least one array, each array comprising at least one row extending along the process direction span and a plurality of columns, each column extending along a cross-process direction span, a quantity of columns and a quantity of rows for each array based at least in part on a size dimension for the selected target media in the process direction and the cross-process direction respectively;

b) detecting each test pattern image on the image receiving member;

c) determining a process registration measurement associated with the first color separation in relation to the reference color separation for each test pattern image;

d) determining a repeatable process registration error pattern associated with the first color separation and the selected target media in relation to the cyclic characteristic based at least in part on the process registration measurements determined in c), wherein the process registration measurements associated with each column of one or more test patterns are represented in the first repeatable registration error pattern such that column-level resolution is provided for the first repeatable registration error pattern in the process direction.

23. The method set forth in claim 22 further comprising:

e) determining a cross-process registration measurement associated with the first color separation in relation to the reference color separation for each test pattern image; and f) determining a repeatable cross-process registration error pattern associated with the first color separation and the selected target media in relation to the cyclic characteristic based at least in part on the cross-process registration measurements determined in a).

24. The method set forth in claim 23, further comprising:

g) averaging process registration measurements for test pattern images positioned in cross-process direction relation during the determining in e); and h) averaging first cross-process registration measurements for test pattern images positioned in cross-process direction relation during the determining in f).

25. The method set forth in claim 23 wherein the process direction span for the marking in a) continues for a plurality of cycles in relation to the cyclic characteristic, further comprising:

g) averaging process registration measurements for test pattern images positioned in cyclic relation with respect to absolute cross-process direction for the cyclic characteristic during the determining in e); and h) averaging cross-process registration measurements for test pattern images positioned in cyclic relation with respect to absolute cross-process direction for the cyclic characteristic during the determining in f).

* * * * *